US009943110B2

(12) United States Patent
Liu

(10) Patent No.: US 9,943,110 B2
(45) Date of Patent: Apr. 17, 2018

(54) ELECTRONIC CIGARETTE AND METHOD FOR CONTROLLING ATOMIZATION THEREOF

(71) Applicant: HUIZHOU KIMREE TECHNOLOGY CO., LTD, Huizhou, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen, Guangdong (CN)

( * ) Notice: Subject to any disclaimer, the term of this patent is extended or adjusted under 35 U.S.C. 154(b) by 52 days.

(21) Appl. No.: 15/150,632

(22) Filed: May 10, 2016

(65) Prior Publication Data

US 2016/0249684 A1 Sep. 1, 2016

Related U.S. Application Data

(63) Continuation of application No. PCT/CN2014/091163, filed on Nov. 14, 2014.

(51) Int. Cl.
*A24F 47/00* (2006.01)
*H05B 3/00* (2006.01)
(Continued)

(52) U.S. Cl.
CPC ..... *A24F 47/008* (2013.01); *H05B 1/0227* (2013.01); *H05B 3/0014* (2013.01);
(Continued)

(58) Field of Classification Search
CPC ..... A24F 47/00; A24F 1/00; A24F 2700/01; A24F 47/002; A61M 15/06
(Continued)

(56) References Cited

U.S. PATENT DOCUMENTS 6,196,218 B1 * 3/2001 Voges ..... A24F 47/002 128/200.14
6,889,687 B1 * 5/2005 Olsson ..... A61M 15/0091 128/200.14
(Continued)

FOREIGN PATENT DOCUMENTS

CN 101557728 A 10/2009
CN 102389167 A 3/2012
(Continued)

OTHER PUBLICATIONS

International Search Report for PCT/CN2014/091163, dated Mar. 27, 2015, ISA/CN.

*Primary Examiner* — Abdullah Riyami
*Assistant Examiner* — Vladimir Imas
(74) *Attorney, Agent, or Firm* — U.S. Fairsky LLP; Yue Xu

(57) ABSTRACT

An electronic cigarette and a method for controlling atomization of the electronic cigarette are provided. The electronic cigarette includes an atomizer and a battery rod assembly. The atomizer is formed by detachably connecting a liquid cup assembly and an atomizer core. A control unit is provided to be electrically connected to the atomizer and the battery rod assembly. A conductive cartridge that is conductive is sleeved on the battery, and the suction nozzle and the conductive cartridge can be conducted. The control unit controls the battery to supply power to the atomizer to atomize cigarette liquid when detecting that the suction nozzle is conducted with the conductive cartridge, which effectively prevents an automatic operation of the atomizer and avoids a waste of the cigarette liquid and the energy while facilitating the user operation.

16 Claims, 16 Drawing Sheets

(51) Int. Cl.
*H05B 3/02* (2006.01)
*H05B 1/02* (2006.01)
*H05B 3/42* (2006.01)

(52) U.S. Cl.
CPC ..... *H05B 3/026* (2013.01); *H05B 3/42* (2013.01); *H05B 2203/014* (2013.01); *H05B 2203/021* (2013.01); *H05B 2203/022* (2013.01)

(58) Field of Classification Search
USPC ..... 131/328, 273; 128/200.14
See application file for complete search history.

(56) References Cited

U.S. PATENT DOCUMENTS 8,375,957 B2 * 2/2013 Hon ..... A24F 47/008 128/202.21
8,511,318 B2 * 8/2013 Hon ..... A24F 47/002 128/202.21
8,833,364 B2 * 9/2014 Buchberger ..... A61M 11/041 128/200.14
8,863,752 B2 * 10/2014 Hon ..... A24F 47/008 128/202.21
9,101,729 B2 * 8/2015 Liu ..... A61M 15/06
9,155,336 B2 * 10/2015 Liu ..... A24F 47/002
9,370,205 B2 * 6/2016 Hon ..... A24F 47/008
9,386,805 B2 * 7/2016 Liu ..... A24F 47/008
9,426,977 B1 * 8/2016 Wynalda, Jr. ..... A01M 31/008
9,427,023 B2 * 8/2016 Liu ..... A24F 47/002
2008/0092912 A1 4/2008 Robinson et al.
2011/0011396 A1 * 1/2011 Fang ..... A24F 47/008 128/202.21
2011/0277756 A1 11/2011 Terry
2011/0303231 A1 * 12/2011 Li ..... A24F 47/008 131/329
2013/0220315 A1 8/2013 Conley et al.
2013/0319407 A1 * 12/2013 Liu ..... A61M 15/06 128/202.21
2014/0007891 A1 * 1/2014 Liu ..... A24F 47/002 131/329
2014/0190477 A1 7/2014 Qiu
2014/0261408 A1 * 9/2014 DePiano ..... A24F 47/008 128/202.21
2015/0059787 A1 * 3/2015 Qiu ..... H05B 3/14 131/329
2015/0208726 A1 * 7/2015 Liu ..... H05B 1/0244 131/329
2016/0143354 A1 * 5/2016 Liu ..... A24F 47/002 131/329
2016/0242464 A1 * 8/2016 Liu ..... A24F 47/008
2016/0249684 A1 * 9/2016 Liu ..... A24F 47/008
2016/0302487 A1 * 10/2016 Chen ..... A24F 47/00

FOREIGN PATENT DOCUMENTS

CN 203168034 U 9/2013
CN 203446525 U 2/2014
TW 201208724 A 3/2012

* cited by examiner

ELECTRONIC CIGARETTE AND METHOD FOR CONTROLLING ATOMIZATION THEREOF

CROSS-REFERENCE TO RELATED APPLICATIONS

This application is a continuation of International Application No. PCT/CN2014/091163, titled "ELECTRONIC CIGARETTE AND METHOD FOR CONTROLLING ATOMIZATION THEREOF", filed on Nov. 14, 2014, the entire disclosure of which is incorporated herein by this reference.

FIELD

The present application relates to the field of electronic cigarettes, and in particular to an electronic cigarette and a method for controlling atomization of the electronic cigarette.

BACKGROUND

As a new type electronic product, an electronic cigarette has the same appearance and taste with a conventional cigarette. Compared with the conventional cigarette, the electronic cigarette is healthier and more environmentally friendly.

In conventional art, the electronic cigarette generally includes an atomizer assembly for atomizing cigarette liquid and a battery assembly for powering the atomizer assembly. In a current electronic cigarette, a control circuit integrated with an air flow sensor is used for controlling the electronic cigarette. When the electronic cigarette is smoked by a user, the pressure in the electronic cigarette varies, which causes a film capacitor of the air flow sensor to deform. When the deformation of the film capacitor reaches to a threshold value, a trigger signal is send to a microprocessor of the control circuit so that the battery assembly is controlled to supply power to the atomizer assembly through the microprocessor, thus the cigarette liquid is atomized into smoke.

The pressure in such an electronic cigarette, however, can vary in the process of packaging or transportation easily, which causes the electronic cigarette to automatically operate. Further, a longtime automatic operation of the electronic cigarette may cause a risk of fire and explosion, and cause the atomized cigarette liquid to be metamorphic and stale due to the atomized cigarette liquid being oxidized by air repeatedly. Furthermore, in the current electronic cigarette, for sensing the pressure variation in the electronic cigarette by the air flow sensor, an air passage is provided for communicating with the air flow sensor, thus, the cigarette liquid may easily flow to the battery assembly and the air flow sensor along the air passage during the operation of the electronic cigarette, thus the air flow sensor and the battery assembly may be damaged, causing the battery of the electronic cigarette to be short-circuited or not to work, which affects the service life of the electronic cigarette.

Another current electronic cigarette has a mechanical button switch, instead of the air flow sensor, for controlling the electronic cigarette to atomize the cigarette liquid. However, since the high frequency of button being pressed in the operation of the electronic cigarette, such a button switch is apt to fail in the long-term press process. Therefore, in another electronic cigarette, the button switch is replaced by a touch switch for controlling the electronic cigarette.

However, in the electronic cigarette including the button switch or the touch switch, the situation of an automatic operation of the electronic cigarette due to being pressed, touched by packers, or touched by transport workers in the process of packing or transportation may also exist, and if a user needs to smoke, the button switch or the touch switch needs to be pressed, which increases steps of smoking, and thus increases operation complexity in the smoking process, which affects the smoking experience of the user.

SUMMARY

An electronic cigarette and a method for controlling atomization of the electronic cigarette are provided by the present application.

An electronic cigarette includes an atomizer and a battery rod assembly detachably connected to the atomizer. A battery is provided in the battery rod assembly with for powering the atomizer to atomize cigarette liquid. The electronic cigarette further includes a control unit electrically connected to the atomizer and the battery rod assembly.

The atomizer includes a liquid cup assembly, a suction nozzle and an atomizer core. The liquid cup assembly includes a liquid storage cartridge and an air tube inserted in the liquid storage cartridge. The suction nozzle made of a conductive material is provided at an end of the liquid cup assembly facing away from the battery rod assembly, and the atomizer core detachably connected to the liquid cup assembly for atomizing cigarette liquid is provided at the other end of the liquid cup assembly. The atomizer core is provided with a smoke passage and an elastic conductive arm extending into the smoke passage. The air tube made of a conductive material is inserted in the smoke passage and elastically abuts against the elastic conductive arm. The elastic conductive arm is electrically connected to the control unit. The elastic conductive arm is electrically connected to the suction nozzle through the air tube. A conductive cartridge electrically connected to the control unit is provided on an outer periphery surface of the battery rod assembly.

A user can touch the suction nozzle and the conductive cartridge via skin when smoking, which allows the suction nozzle to conduct with the conductive cartridge, and the control unit controls the battery to supply power to the atomizer so that the cigarette liquid is atomized when the control unit detects that the suction nozzle is conducted with the conductive cartridge.

Preferably, the control unit is provided in the battery rod assembly. A conductive ring sleeved on the smoke passage is provided at an end of the atomizer core. An inner periphery surface of the conductive ring is formed with at least one elastic conductive arm extending slantingly in a direction away from the suction nozzle. An atomizer electrode assembly electrically connected to the battery rod assembly and the control unit is provided at the other end of the atomizer. The air tube is inserted in the smoke passage. The elastic conductive arm elastically abuts against a side wall of the air tube, and, if multiple elastic conductive arms are provided, one of the elastic conductive arms is electrically connected to the atomizer electrode assembly through a wire.

Preferably, a side wall of the atomizer core is provided with an air inlet which is communicated with an outer surface of the atomizer and the smoke passage, and the atomizer electrode assembly blocks an end of the smoke passage such that the smoke passage is isolated from the battery rod assembly.

Preferably, the atomizer core includes a hollow atomizing seat. A smoke passage is formed in the atomizing seat. A liquid storage cavity is provided between the smoke passage and an inner periphery wall of the liquid storage cartridge. A side wall of the atomizing seat is provided with a liquid inlet passage in communication with the liquid storage cavity. The atomizer electrode assembly is inserted at an end of the atomizing seat. A liquid absorber for absorbing the cigarette liquid in the liquid storage cavity from the liquid inlet passage and an electric heating wire for atomizing the cigarette liquid on the liquid absorber is provided in the smoke passage. The atomizer electrode assembly includes a first insulating cartridge inserted in the atomizing seat, a first electrode inserted in the first insulating cartridge, a second insulating cartridge inserted in the first electrode and a second electrode inserted in the second insulating cartridge. The second electrode has a solid column structure and is electrically connected to the elastic conductive arm, and two ends of the electric heating wire are electrically connected to the atomizing seat and the first electrode respectively for being electrically connected to the battery.

Preferably, the electronic cigarette further includes a wire for electrically connecting the elastic conductive arm to the atomizer electrode assembly. Specifically, an end of the wire is connected to the elastic conductive arm by welding, and the other end of the wire is sandwiched between the second electrode and the second insulating cartridge.

Preferably, the atomizer core further includes an atomizing cover sleeved on an end, facing away from the battery rod assembly, of the atomizing seat and an insulator and an elastic seal. Both of the insulator and the elastic seal are located in the atomizing cover and sleeved on the air tube. Two ends of the elastic seal abut against an end wall of the atomizing cover and the insulator respectively, and two ends of the insulator abut against the elastic seal and an end of the atomizing seat. The conductive ring is sandwiched between the insulator and the elastic seal.

Preferably, the liquid storage cartridge is made of a light-transmittable non-metallic material. The suction nozzle is made of a metallic material and is fixed at an end of the liquid storage cartridge, and an end of the liquid storage cartridge facing away from the suction nozzle is fixedly provided with a connecting sleeve detachably connected to the atomizer core.

Preferably, the battery rod assembly includes the conductive cartridge made of a metallic material, the battery inserted in the conductive cartridge, a connector inserted at an end of the conductive cartridge for connecting with the atomizer, and an end cover inserted at an end, facing away from the connector, of the conductive cartridge. The control unit is provided in the battery rod assembly.

Preferably, the connector includes a connecting sleeve electrically connected to the control unit, and a first elastic electrode and a second elastic electrode inserted into the connecting sleeve. The first elastic electrode is located at an axis of the battery rod assembly. The first elastic electrode and the second elastic electrode elastically abut against and are electrically connected to the atomizer core.

Preferably, the first elastic electrode includes a fixing cartridge, an electrode column movably inserted in the fixing cartridge and extending out of the fixing cartridge, and an elastic element. Two ends of the elastic element elastically abut against the fixing cartridge and the electrode column respectively, and an end, facing away from the elastic element, of the electrode column elastically abuts against the atomizer core.

Preferably, the control unit includes a microprocessor, a filtering unit electrically connected to the conductive cartridge for filtering an input signal, a first transistor switch unit electrically connected to the filtering unit for transmitting an output signal to the microprocessor from the filtering unit, a second transistor switch unit electrically connected to the microprocessor and the atomizer. The microprocessor is configured to control the second transistor switch unit to be turned on or off based on an input signal from the first transistor switch unit, so as to control the atomizer to atomize cigarette liquid or not.

Preferably, the control unit includes a microprocessor, a filtering unit electrically connected to the conductive cartridge for filtering an input signal, a comparison circuit unit c electrically connected to the filtering unit for comparing an output signal from the filtering unit and delivering a comparison result to the microprocessor, a third transistor switch unit electrically connected to the microprocessor and the atomizer. The microprocessor is configured to control the third transistor switch unit to be turned on or off based on an input signal from the comparison circuit unit, so as to control the atomizer assembly to atomize cigarette liquid or not.

A method for controlling atomization of an electronic cigarette, includes detecting, by a control unit provided in the electronic cigarette, whether a suction nozzle and a conductive cartridge are conducted, wherein a battery rod assembly configured to supply power to an atomizer is further provided in the electronic cigarette, and the conductive cartridge is sleeved on an outer periphery surface of the battery rod assembly, and each of the suction nozzle and the conductive cartridge is made of a conductive material, and each of the suction nozzle and the conductive cartridge is electrically connected to the control unit, controlling, by the control unit, the battery rod assembly to supply power to the atomizer so as to atomize cigarette liquid if the control unit detects that the suction nozzle is conducted with the conductive cartridge.

The present application provides an electronic cigarette and a method for controlling atomization of the electronic cigarette. The electronic cigarette includes an atomizer and a battery rod assembly. The atomizer is formed by a liquid cup assembly and an atomizer core which are detachably connected. That is, in the assembly of the atomizer, the atomizer core is inserted at an end of the liquid cup assembly away from the suction nozzle, thus simplifying the assembling process and improving the assembly efficiency. Further, if the atomizer core or the liquid cup assembly is broken, only the broken atomizer core or liquid cup assembly needs to be replaced, which does not require the whole atomizer to be replaced, thus reducing the subsequent maintenance costs for the subsequent use of the electronic cigarette. Further, the air tube is inserted in the smoke passage just by inserting the atomizer core on the liquid cup assembly, such that a side wall of the air tube in the smoke passage abuts against and extends into the elastic conductive arm in the smoke passage, which allows the elastic conductive arm to be in a compressed state, thus effectively improving the stability of the electrical connection of the atomizer core and the air tube, and effectively avoiding the electrical disconnection and avoiding the battery rod assembly from being unable to supply power to the atomizer. Further, in the assembly of the atomizer, only the atomizer core needs to be inserted to an end of the liquid cup assembly away from the suction nozzle, such that the elastic conductive arm closely abuts against the side wall of the air tube in the smoke passage, thus the electrical connection of the control unit and the suction nozzle can be realized without extra steps, which effectively improves the production efficiency. Furthermore, a conductive cartridge that is conductive is sleeved on the battery, thus the user can touch the suction nozzle and the conductive cartridge via skin when smoking, which allows the suction nozzle to conduct with the conductive cartridge. The control unit controls the battery to supply power to the atomizer to atomize cigarette liquid when the control unit detects that the suction nozzle is conducted with the conductive cartridge, thus an automatic operation of the atomizer is effectively prevented without additional operations, and a waste of the cigarette liquid and the energy is avoided while facilitating the operation of the user, which increases the service life of the electronic cigarette and improves the safety in transportation and usage.

DETAILED DESCRIPTION

A first embodiment is described. The specific structure of an electronic cigarette, which is able to prevent the electronic cigarette from automatically operating and enhance the user experience, is described in detail in the present embodiment.

Figure 1:
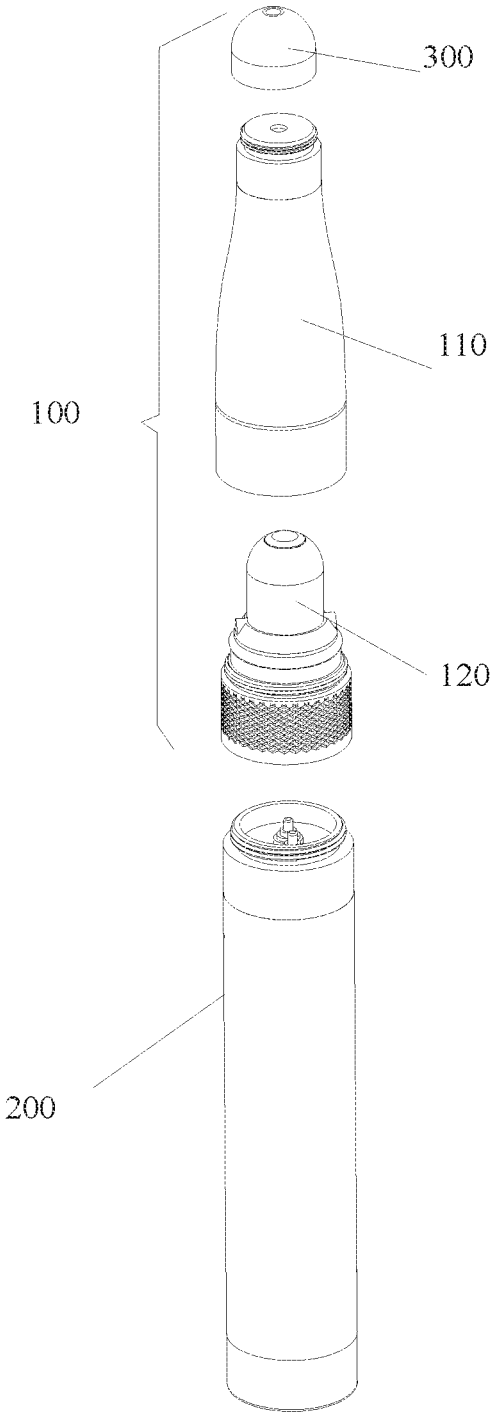
FIG. 1 is an explosive schematic view showing a connection structure of an electronic cigarette provided by a preferred embodiment of the present invention.
Figure 2:
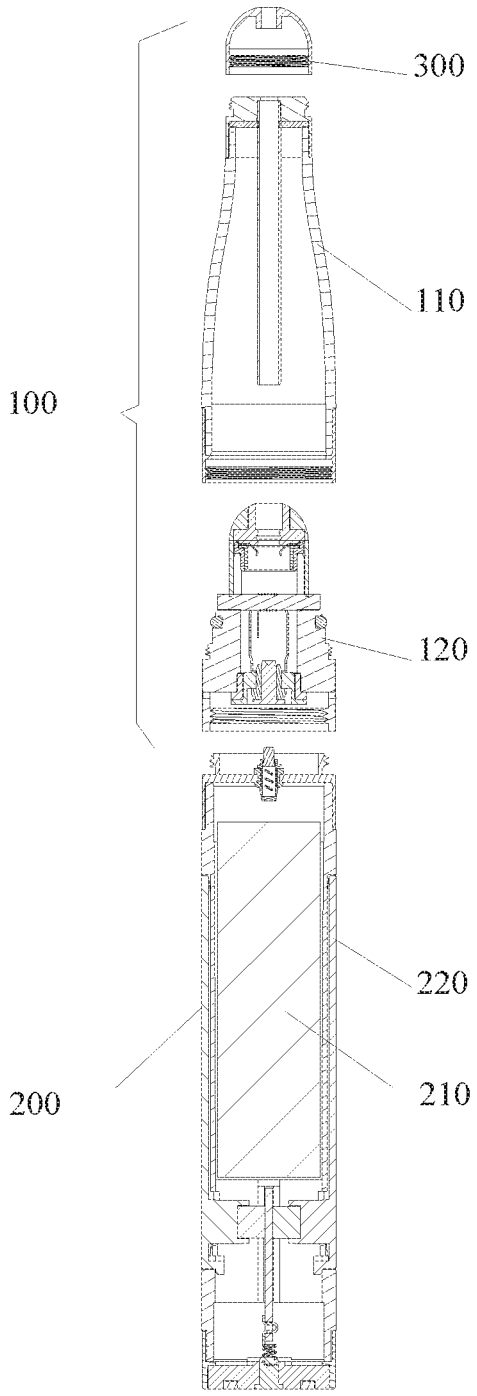
FIG. 2 is an explosive schematic view showing the section of the connection structure of the electronic cigarette provided by the embodiment of the present invention.
Figure 3:
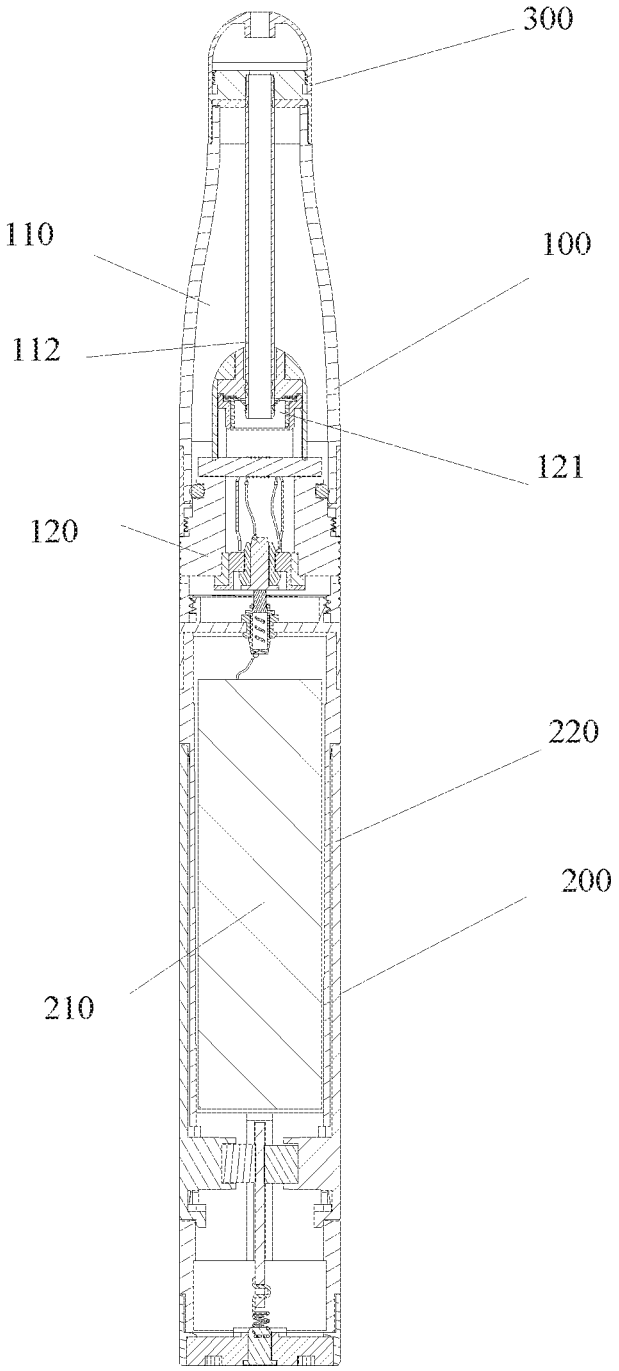
FIG. 3 is a schematic view showing the section of the structure of the electronic cigarette provided by the preferred embodiment of the present invention.

Specifically, reference is made to FIGS. 1, 2 and 3. FIG. 1 is an explosive schematic view showing a connection structure of an electronic cigarette provided by a preferred embodiment of the present invention. FIG. 2 is an explosive schematic view showing the section of the connection structure of the electronic cigarette provided by the embodiment of the present invention. FIG. 3 is a schematic view showing a preferred embodiment of the section of the structure of the electronic cigarette provided by the embodiment of the present invention.

As shown in FIGS. 1, 2 and 3, the electronic cigarette includes:

an atomizer 100 for storing cigarette liquid and atomizing the cigarette liquid into smoke to be sucked by a user based on an operation of the user, a battery rod assembly 200 connected to the atomizer, the battery rod assembly 200 includes a battery 210 for providing power to the atomizer 100 such that cigarette liquid is atomized into smoke by the atomizer 100.

As shown in FIGS. 1, 2 and 3, in the electronic cigarette provided by the present embodiment, the atomizer 100 is assembled with the battery rod assembly 200 so as to form a body of the electronic cigarette. Further, the atomizer 100 and the battery rod assembly 200 are arranged coaxially, and the atomizer 100 is located at an upper end of the body of the electronic cigarette and the battery rod assembly 200 is located at an lower end of the body of the electronic cigarette. The advantage of such arrangement is that the electronic cigarette imitates the overall shape of a real cigarette, which follows the user's habits. Furthermore, the atomizer 100 is provided close to a suction nozzle 300 for being sucked, which avoids the smoke atomized by the atomizer 100 being condensed and further avoids the users sucking the cigarette liquid.

A control unit is provided to be electrically connected to the atomizer 100 and the battery rod assembly 200, and each of the specific structure and specific location of the control unit is not defined by the present embodiment, as long as the battery rod assembly 200 can provide power to the atomizer 100 via the control unit based on the respective operation of the user.

Specifically, the atomizer 100 includes: a liquid cup assembly 110, an atomizer core 120, and the suction nozzle 300.

The specific structure of the liquid cup assembly 110 will be described in detail below in conjunction with FIG. 4. The liquid cup assembly 110 specifically includes:

a liquid storage cartridge 111, and an air tube 112 inserted into the liquid storage cartridge 111.

The suction nozzle 300 made of a conductive material is provided at an end of the liquid cup assembly 110 facing away from the battery rod assembly 200, and the suction nozzle 300 is in communication with the air tube 112, such that the smoke atomized by the atomizer 100 can be communicated to the suction nozzle 300 via the air tube 112, and thus the user can suck the smoke through the suction nozzle 300.

In the present embodiment, the suction nozzle 300 can be connected to the liquid storage cartridge 111 fixedly or detachably. Specifically, the detachable connection can be a thread connection, snap-fit connection and so on. In the present embodiment, preferably, as an example, the suction nozzle 300 is detachably connected to the liquid storage cartridge 111. Because the detachable connection is convenient for the user to replace the suction nozzle 300, the sanitation in the process of using the electronic cigarette is improved.

The atomizer core 120, detachably connected to the liquid cup assembly 110, for atomizing the cigarette liquid is provided at the other end of the liquid cup assembly 110.

Figure 5:
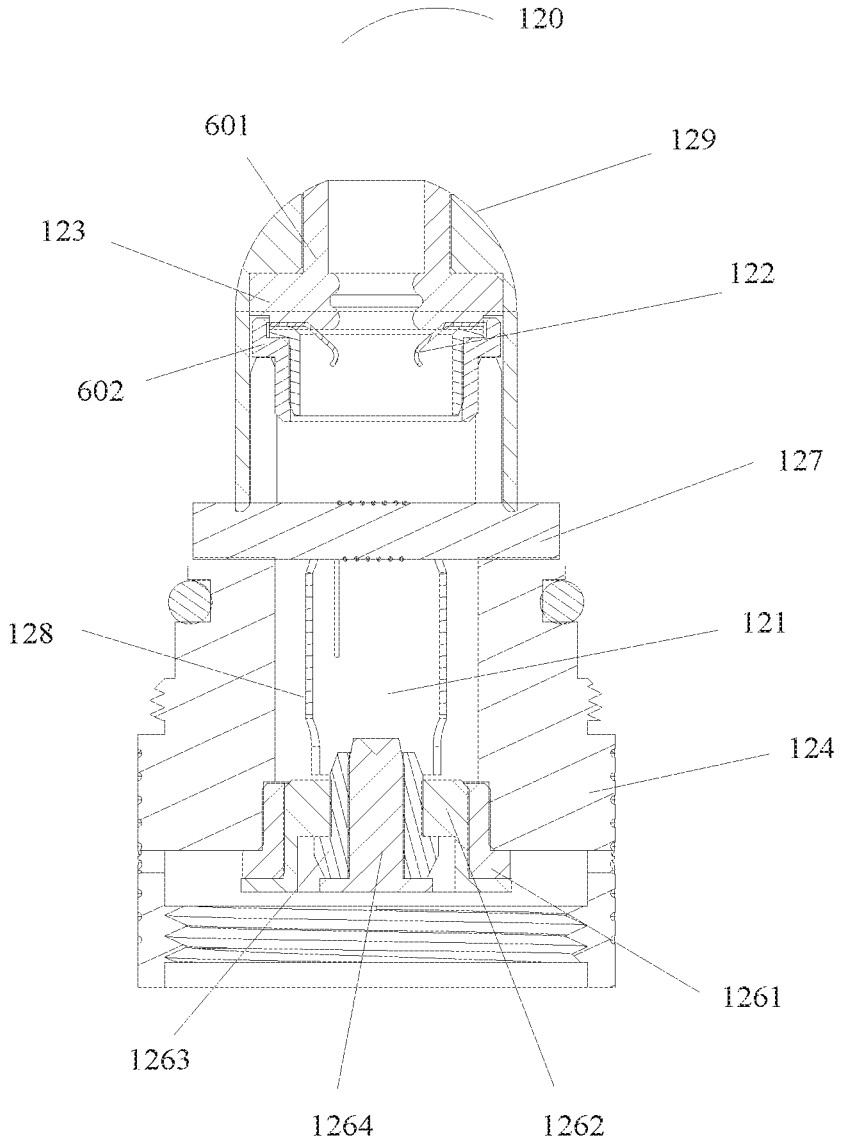
FIG. 5 is a schematic view showing the section of another partial structure of the electronic cigarette provided by the embodiment of the present invention.

Specifically, a connection structure of the liquid cup assembly 110 and the atomizer core 120 is as shown in FIG. 3, and a specific structure of the atomizer core 120 is as shown in FIG. 5.

One end of the atomizer core 120 is connected to the air tube 112, and the other end of the atomizer core 120 is connected to the battery rod assembly 200 (as shown in FIG. 3).

In the present embodiment, the atomizer 100 is formed by connecting the liquid cup assembly 110 to the atomizer core 120 detachably. That is, in the assembly process of the atomizer 100, the atomizer core 120 is mounted at the end of the liquid cup assembly 110 away from the suction nozzle 300, which simplifies the assembly process and improves assembly efficiency. Further, if the atomizer core 120 or the liquid cup assembly 110 is damaged, only the damaged atomizer core 120 or liquid cup assembly 110 needs to be replaced, and the whole atomizer 100 does not need to be replaced, which reduces the subsequent maintenance costs for the user of the electronic cigarette. Further, during the replacement of the atomizer core 120 or the liquid cup assembly 110, only the atomizer core 120 needs to be inserted into an end of the liquid cup assembly 110 away from the suction nozzle 300, which does not need complex operations, thus avoiding the assembled atomizer 100 unable to work due to an insufficient operation accuracy.

The specific structure of the atomizer core 120 will be described in detail below.

As shown in FIGS. 3 and 5, the atomizer core 120 is provided with a smoke passage 121 and an elastic conductive arm 122 extending into the smoke passage 121. The elastic conductive arm 122 is electrically connected to the control unit. The air tube 112 made of a conductive material is inserted into the smoke passage 121 (as shown in FIG. 3). The elastic conductive arm 122 elastically abuts against the side wall of the air tube 112, such that the elastic conductive arm 122 is electrically connected to the suction nozzle 300 via the air tube 112.

At least one elastic conductive arm 122 may be provided by the present embodiment.

Preferably, in order to realize a stable electrical connection of the control unit and the suction nozzle 300, paired elastic conductive arms 122 may be preferably provided, and the elastic conductive arms 122 provided in pairs are arranged symmetrically about the axial direction of the air tube 112.

Specifically, the air tube 112 is inserted into the smoke passage 121, such that the air tube 112 is located in and abuts against the side wall of the smoke passage 121 and extends to the elastic conductive arm 122 in the smoke passage 121, making the elastic conductive arm 122 in a compressed state. The compressed elastic conductive arm 122 closely abuts against the side wall of in the smoke passage 121 where the air tube 112 is located. As the elastic conductive arm 122 is made of a conductive material and the elastic conductive arm 122 is electrically connected to the control unit, the stability of the electrical connection of the atomizer core 120 and the air tube 112 can be effectively improved by the specific structure of the atomizer 100 according to the present embodiment, thus effectively avoiding the electrical connection from being interrupted and avoiding the battery rod assembly 200 from being unable to provide power to the atomizer 100 normally, and in the assembly process of the atomizer 100, only the atomizer core 120 needs to be inserted to an end of the liquid cup assembly 100 away from the suction nozzle 300, such that the elastic conductive arm 122 closely abuts against the side wall of the smoke passage 121 where the air tube 112 is located, thus the electrical connection of the control unit and the suction nozzle 300 can be realized without extra steps, effectively improving the production efficiency.

In the present embodiment, in order to prevent the automatic operation of the electronic cigarette, the electronic cigarette provided by the present embodiment further includes:

as shown in FIGS. 2 and 3, a conductive cartridge 220 electrically connected to the control unit, and the conductive cartridge 220 is provided at an outer periphery surface of the battery rod assembly 200.

The conductive cartridge 220 may be sleeved onto the battery 210, such that the conductive cartridge 220 may accommodate the battery 210 completely. The specific material of the conductive cartridge 220 is not defined by the present embodiment, as long as the conductive cartridge 220 is conductive.

Since both of the suction nozzle 300 and the conductive cartridge 220 in the present embodiment are conductive and are electrically connected to the control unit, the user can conduct the suction nozzle 300 with the conductive cartridge 220 when smoking by touching the suction nozzle 300 with the conductive cartridge 220 through skin. When it is detected that the suction nozzle 300 is conducted with the conductive cartridge 220, the battery 210 is controlled to provide power to the atomizer 100 by the control unit so as to atomize cigarette liquid.

The advantage of the specific structure of the electronic cigarette according to the present embodiment is in that, in the using process of the electronic cigarette according to the present embodiment, the user can touch the suction nozzle 300 with mouth and touch the conductive cartridge 220 with fingers naturally, such that the suction nozzle 300 is conducted with the conductive cartridge 220, which follows the user's habit and facilitates usage. Thus, the automatic operation of the atomizer 100 can be effectively avoided without adding additional operation, which facilitates the operation of the user and avoids the waste of cigarette liquid and energy at the same time, thus increasing the service life of the electronic cigarette and improving the security in transport and usage.

When the electronic cigarette according to the present embodiment is not smoked by the user, the suction nozzle 300 is disconnected to the conductive cartridge 220, and the battery rod assembly 200 is unable to provide power to the atomizer 100, thus in the packaging process and transportation process, the control unit is unable to allow the battery rod assembly 200 to provide power to the atomizer 100, thus effectively avoiding the waste of cigarette liquid and the unwanted service life reducing of the electronic cigarette resulting from the automatic operation of the electronic cigarette in the case that no corresponding operations of the user is implemented. Compared with the conventional art, the electronic cigarette of the present embodiment effectively avoids accidents, such as a risk of fire or explosion resulting from a longtime automatic operation of the electronic cigarette, thus improving the security, effectively reducing the possibility of the atomizer 100 being triggered unintentionally to atomize the cigarette liquid.

Certainly, the user can touch the suction nozzle 300 and the conductive cartridge 220 simultaneously through other conductive materials, in this way, the control unit can control the battery rod assembly 200 to provide power to the atomizer 100.

Preferably, in the present embodiment, if the user wants to smoke, only the suction nozzle 300 and the conductive cartridge 220 need to be touched simultaneously, which does not need the suction and pressing operations, thus steps and difficulties in operation are reduced, and the smoking experience is improved.

In the conventional art, an air flow sensing switch for sensing the smoking action is provided in the electronic cigarette, however, smoke may be condensed into cigarette liquid in the process of circulation in the electronic cigarette. The condensed cigarette liquid may flow into the air flow sensing switch. If the quantity of the cigarette liquid in the air flow sensing switch is accumulated to a certain extent, the air flow sensing switch will be unable to work normally, thus the atomizer is also unable to work normally even if the user sucks the electronic cigarette, thereby reducing the service life of the electronic cigarette. The electronic cigarette provided by the present embodiment, however, is not provided with the air flow sensing switch in the electronic cigarette, thus the liquefied cigarette liquid will not affect the electrical connection in the electronic cigarette. As long as the user touches the suction nozzle 300 and the conductive cartridge 220 simultaneously by skin, the battery rod assembly 200 can provide power to the atomizer 100, which increases the service life of the electronic cigarette. Since there is no need to provide the air flow sensing switch, the cost of the electronic cigarette is effectively reduced, and the problems of, the air flow sensor being unable to sense "smoking" signal due to small smoking intensity and a short circuit caused by the cigarette liquid passing into the battery assembly via the air passage, are avoided.

A second embodiment is described. The specific structure of the electronic cigarette is further described in detail in the present embodiment.

The control unit is provided in the battery rod assembly 200, and the specific location is not defined.

Figure 6:
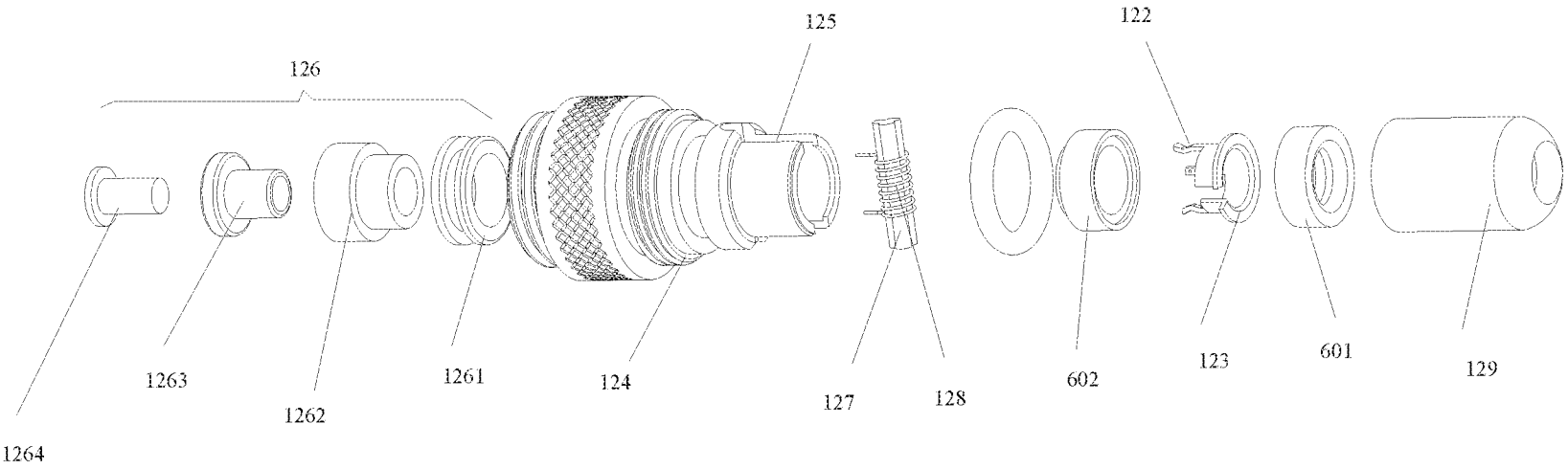
FIG. 6 is an explosive schematic view showing a connection structure of an atomizer core provided by the embodiment of the present invention.

As shown in FIGS. 5 and 6, a conductive ring 123 is sleeved on the smoke passage and is provided at an end of the atomizer core 120. The inner periphery surface of the conductive ring 123 is formed with at least one the elastic conductive arm 122, which extend slantingly in a direction away from the suction nozzle 300.

In the present embodiment, the description is made by an example that two elastic conductive arms 122 are provided and the two elastic conductive arms 122 are arranged opposite to each other. Reference may further be made to FIG. 6. FIG. 6 is an explosive schematic view showing a connection structure of an atomizer core provided by the embodiment of the present invention.

That is, in the assembly process of the atomizer core 120, the conductive ring 123 is sleeved on one end of the smoke passage 121, such that the elastic conductive arms 122 on the conductive ring 123 extend into the smoke passage 121, which is convenient for the user to assemble and improves the reliability of the electrical connection.

An atomizer electrode assembly 126 electrically connected to the battery rod assembly 200 and the control unit is provided at the other end of the atomizer core 120, and the air tube 112 is inserted in the smoke passage 121, and the elastic conductive arms 122 elastically abut against the side wall of the air tube 122.

Specifically, one of the elastic conductive arms 122 is electrically connected to the atomizer electrode assembly 126 via a wire.

Figure 7:
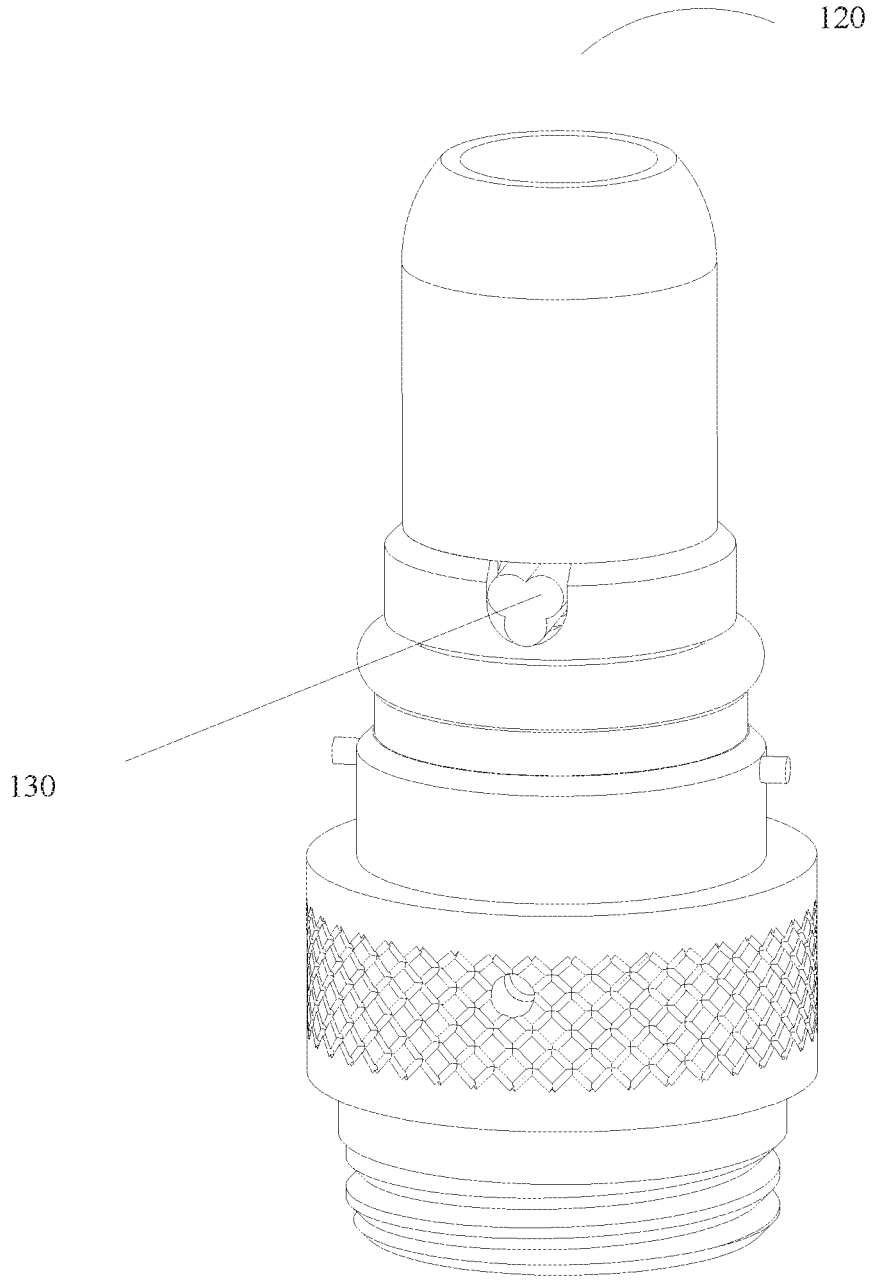
FIG. 7 is a schematic view showing the whole structure of the atomizer core provided by the embodiment of the present invention.

More specifically, as shown in FIG. 7, FIG. 7 is a schematic view showing the overall structure of the atomizer core provided by the embodiment of the present invention.

As shown in FIGS. 5, 6 and 7, a side wall of the atomizer core 120 is provided with an air inlet 130 in communication with an outer surface of the atomizer 100 and the smoke passage 121. The atomizer electrode assembly 126 blocks at the end of the smoke passage 121 close to the battery rod assembly 200, such that the smoke passage 121 and the battery rod assembly 200 are isolated from each other. The advantage of such arrangement is in that the cigarette liquid stored in the atomizer 100 can be effectively prevented from leaking into the battery rod assembly 200 to damage the battery 210, thus avoiding the electronic cigarette being unable to work normally due to the damage of the battery 210, and thus increasing the service life of the electronic cigarette.

The specific structure of the atomizer core 120 is further described in detail below.

The atomizer core 120 includes:

a hollow atomizing seat 124.

The smoke passage 121 is formed in the atomizing seat 124, and a liquid storage cavity is provided between the smoke passage 121 and an inner periphery wall of the liquid storage cartridge 111, such that the cigarette liquid is stored in the atomizer 100 by the liquid storage cavity.

In order to facilitate the user knowing the amount of the cigarette liquid stored in the liquid storage cavity at any time and further avoid the atomizer being unable to work normally due to an insufficient amount of the cigarette liquid, the liquid storage cartridge 111 may be made of a light-transmittable non-metallic material in the present embodiment.

Figure 4:
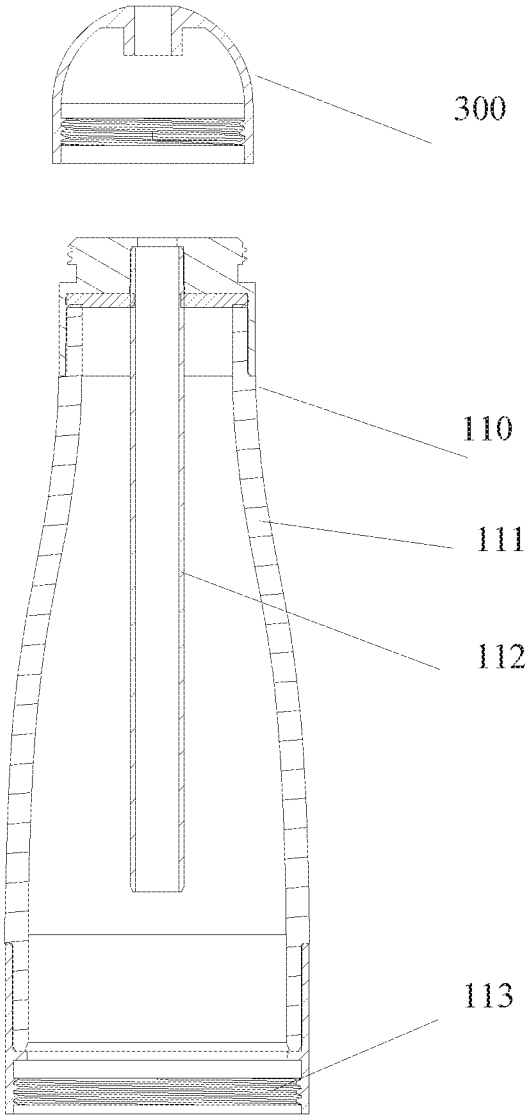
FIG. 4 is a schematic view showing the section of a partial connection structure of the electronic cigarette provided by the embodiment of the present invention.

Preferably, as shown in FIG. 4, the suction nozzle 300 shown in the present embodiment is made of a non-metallic material and is secured at an end of the liquid storage cartridge 111, an end of the liquid storage cartridge 111 facing away from the suction nozzle 300 is securely provided with a connecting sleeve 113 for being detachably connected to the atomizer core 120.

In the present embodiment, as shown in FIG. 4, a structure, such as a threaded section, a sliding rail or a snap-fit structure, for being detachably connected to the atomizer core 120 is provided at an inner periphery wall of the connecting sleeve 113. The specific way of the detachable connection is not repeated in the present embodiment.

A liquid inlet passage 125 (as shown in FIG. 6) in communication with the liquid storage cavity is provided at a side wall of the atomizing seat 124.

An atomizer electrode assembly 126 electrically connected to the battery rod assembly 200 is connected to an end of the atomizing seat 124, that is, the atomizer 100 is electrically connected to battery rod assembly 200 through the atomizer electrode assembly 126.

A liquid absorber 127, configured to absorb cigarette liquid in the liquid storage cavity from the liquid inlet passage 125, is provided in the smoke passage, and an electric heating wire 128 configured to atomize cigarette liquid on the liquid absorber 127, and the electric heating wire 128 has a helical structure and is winded on the liquid absorber 127, such that the electric heating wire 128 is sufficiently contact with the liquid absorber 127, thus sufficient cigarette liquid can be delivered to the electric heating wire 128, and thus the smoke atomized by the electric heating wire 128 is uniform and constant, improving the smoking experience of the user.

Preferably, the liquid absorber 127 may be weaved of a glass fiber material, so as to increasing the efficiency of the cigarette liquid delivered to the electric heating wire 128 by the liquid absorber 127.

The atomizer electrode assembly 126 includes a first insulating cartridge 1261 inserted in the atomizing seat 124, a first electrode 1262 inserted in the first insulating cartridge 1261, a second insulating cartridge 1263 inserted in the first electrode 1262, and a second electrode 1264 inserted in the second insulating cartridge 1263.

Preferably, as also shown in FIGS. 5 and 6, the atomizer core 120 further includes an atomizing cover 129 sleeved on an end of the atomizing seat 124 facing away from the battery rod assembly 200, and an insulator 602 and an elastic seal 601 with both of which are located in the atomizing cover 129 and sleeved on the air tube 112.

Specifically, two ends of the elastic seal 601 abut against an end wall of the atomizing cover 129 and the insulator 602, respectively, and two ends of the insulator 602 abut against the elastic seal 601 and an end of the atomizing seat 124, respectively, and the conductive ring 123 is sandwiched between the insulator 602 and the elastic seal 601.

By clamping and securing the conductive ring 123 between the elastic seal 601 and the insulator 602, the conductive ring 123 is prevented from being detached in the process of the electronic cigarette being used, thus avoiding the electrical connection relationship of the conductive ring 123 and the air tube 112 being interrupted, and effectively stabilizing the operation of the atomizer 100.

The electrical connection relationship of the atomizer 100 and other components will be described below in detail in conjunction with FIG. 8.

An end of the electric heating wire 128 is electrically connected to the atomizing seat 124.

Figure 8:
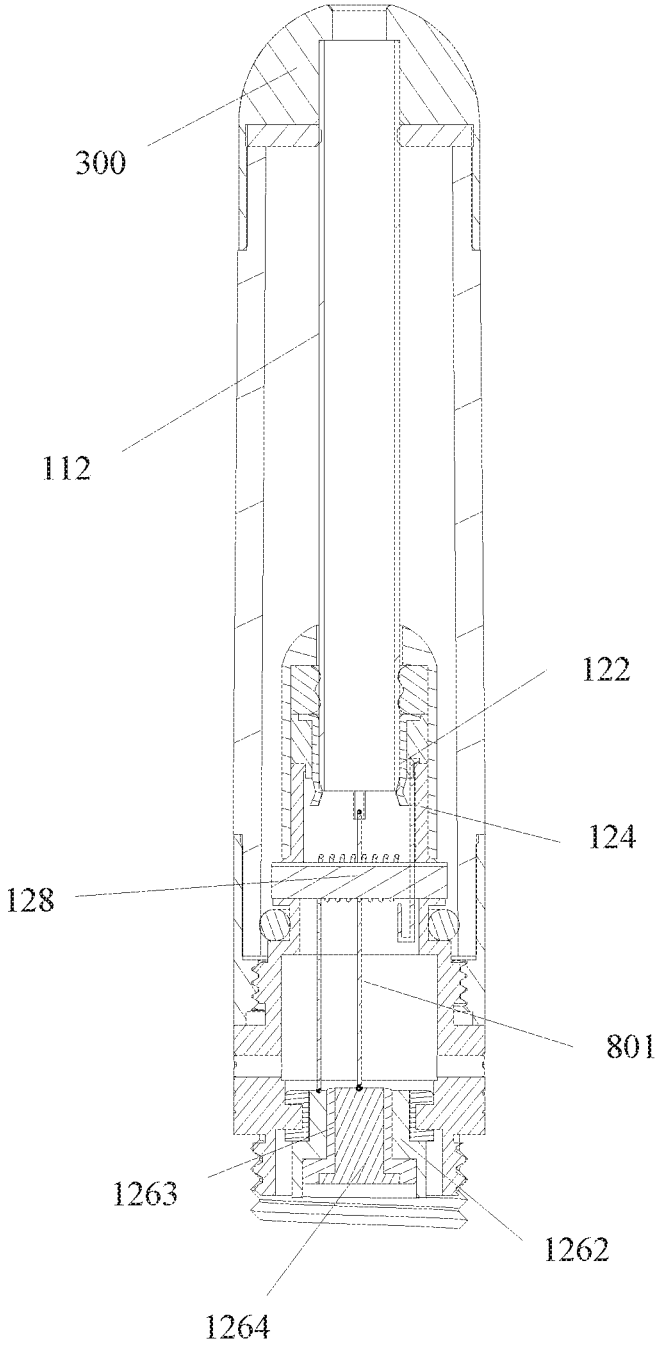
FIG. 8 is a schematic view showing the section of the structure of the atomizer core provided by the embodiment of the present invention.

Specifically, as shown in FIG. 8, an end of the electric heating wire 128 is inserted between the atomizing seat 124 and the elastic conductive arm 122, that is, the end of the electric heating wire 128 is secured by the atomizing seat 124 and the elastic conductive arm 122. Since each of the elastic conductive arm 122 and the air tube 112 is made of a conductive material, and the end of the electric heating wire 128 is electrically connected to the suction nozzle 300 via the elastic conductive arm 122 and the air tube 112 successively, it only needs to insert the end of the electric heating wire 128 between the atomizing seat 124 and the elastic conductive arm 122 in the process of the electrical connection with the structure shown in the present embodiment, so as to facilitate the assembly and improve the assembly efficiency.

The other end of the electric heating wire 128 is electrically connected to the first electrode 1262 so as to be electrically connected to the battery 210.

The electronic cigarette further includes a wire 801 for electrically connecting the elastic conductive arm 122 to the atomizer electrode assembly 126. Specifically, an end of the wire 801 is connected to the elastic conductive arm 122 by welding, and the other end of the wire 801 is sandwiched between the second electrode 1262 and the second insulating cartridge 1263, such that the other end of the wire 801 is clamped and secured by the second electrode 1262 and the second insulating cartridge 1263, thus the second electrode 1262 is electrically connected to the suction nozzle 300 via the wire 801, the elastic conductive arm 122 and the air tube 112 successively.

Since the atomizer electrode assembly 126 is electrically connected to the battery rod assembly 200 and the control unit, as known from the above, if the user touches the suction nozzle 300, the two ends of the electric heating wire 128 are electrically connected to the atomizer electrode assembly 126, as known from the first embodiment, if the user touches the conductive cartridge 220 and the suction nozzle 300 simultaneously, the control unit controls the battery 210 to supply power to the electric heating wire 128, such that the cigarette liquid is atomized into smoke by the electric heating wire 128.

The specific structure of the battery rod assembly will be described in detail in conjunction with FIG. 9.

The battery rod assembly 200 includes the conductive cartridge 220 made of a metallic material, the battery 210 inserted in the conductive cartridge 220, and a connector 201 configured to be mounted at an end of the conductive cartridge 220 for connecting with the atomizer 100. As shown in FIG. 9, a threaded section configured to be detachably connected to the atomizer 100 is provided on an inner periphery wall of the connector 201, such that the atomizer 100 is connected to the battery rod assembly 200 through the threaded section. Apparently, the specific structure of the connector 201 shown in FIG. 9 is illustrated as an example, which is not for limitation, and a sliding rail and a slot may also be provided on the connector 201, and a snap is provided at the end of the atomizer 100 close to the battery rod assembly 200, such that the snap may slide in the guiding direction of the sliding rail, and when the snap slides into the slot, a snap-fit connection of the atomizer 100 and the battery rod assembly 200 is achieved.

Specifically, the conductive cartridge 220 in the present embodiment is made of a conductive metallic material.

The battery 210 is inserted in the conductive cartridge 220.

An end cover 901 is provided for covering an end of the conductive cartridge 220 facing away from the connector 201, and the control unit is provided in the battery rod assembly 200.

Preferably, the end cover 901 is provided to be light-transmittable. A light-emitting component electrically connected to the control unit is provided in the end cover 901, such that when the user smokes, the control unit can control the light-emitting component to emit light, or the light-emitting component can be further configured to indicate a charging state of the battery 210 or other information such as whether the remaining energy is sufficient.

Figure 9:
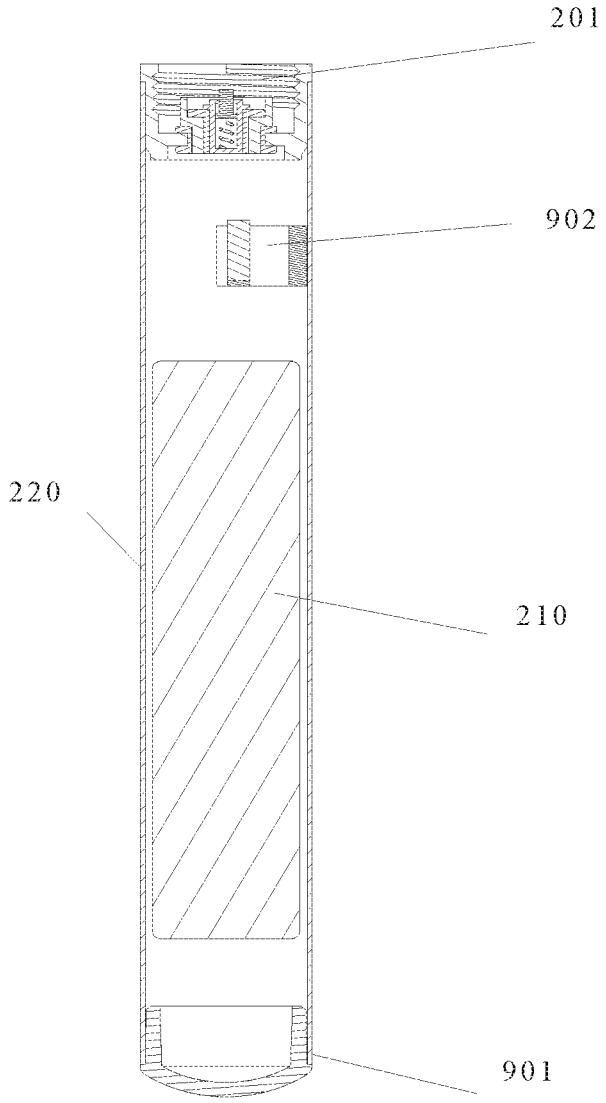
FIG. 9 is a schematic view showing the section of the structure of a battery rod assembly provided by the embodiment of the present invention.
Figure 10:
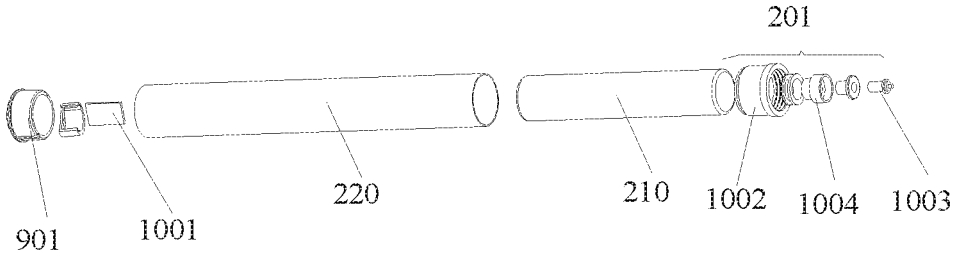
FIG. 10 is an explosive schematic view showing a connection structure of the battery rod assembly provided by the embodiment of the present invention.

Reference is further made to FIG. 9. A PCB plate 902 is also included between the connector 201 and the battery 210. The control unit may be arranged on the PCB plate 902. Or, as shown in FIG. 10, a PCB plate 1001 configured to place the control unit is provided at an end of the battery rod assembly 200 away from the atomizer 100. FIG. 10 is an explosive schematic view showing a connection structure of the battery rod assembly 200.

The specific structure of the battery rod assembly 200 is further described in detail by reference to FIG. 10.

The connector 201 includes a connecting sleeve 1002 electrically connected to the control unit, and a first elastic electrode 1003 and a second elastic electrode 1004 inserted into the connecting sleeve 1002.

The first elastic electrode 1003 is located at an axis of the battery rod assembly 200 and has an annular shape as a whole, and an axis of the first elastic electrode 1003 is coincident with the axis of the battery rod assembly 200.

Specifically, the first elastic electrode 1003 and the second elastic electrode 1004 are arranged coaxially.

The first elastic electrode 1003 and the second elastic electrode 1004 elastically abut against and are electrically connected to the atomizer core 120.

Specifically, when the battery rod assembly 200 is connected to the atomizer 100, the first elastic electrode 1003 abuts against the first electrode 1262 so as to form an electrical connection, and the second elastic electrode 1004 abuts against the second electrode 1264 so as to form an electrical connection, thus the atomizer 100 and the battery rod assembly 200 are electrically connected.

Figure 11:
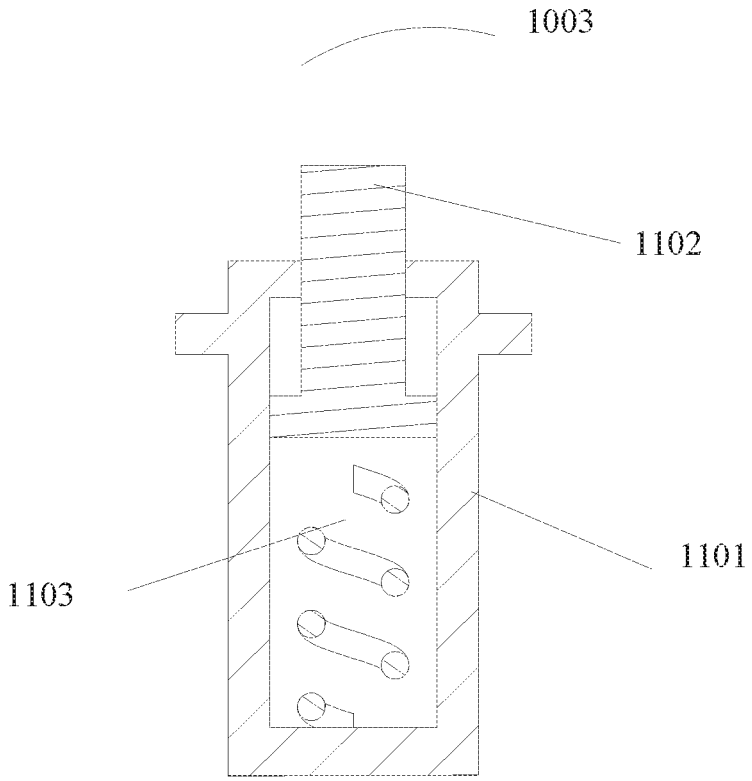
FIG. 11 is a schematic view showing the section of the structure of a first elastic electrode provided by an embodiment of the present invention.

The specific structure of the first elastic electrode 1003 will be described in detail below in conjunction with FIG. 11. FIG. 11 is a sectional schematic view showing the structure of the first elastic electrode 1003 provided by the present invention.

The first elastic electrode 1003 includes a fixing cartridge 1101, an electrode column 1102 movably inserted in the fixing cartridge 1101 and extending out of the fixing cartridge 1101, and an elastic element 1103. Two ends of the elastic element 1103 elastically abut against the fixing cartridge 1101 and the electrode column 1102 respectively, and an end of the electrode column 1102 facing away from the elastic element 1103 elastically abuts against the atomizer core 120.

The advantage of the arrangement of the first elastic electrode 1003 shown in the present embodiment is in that when the atomizer 100 is connected to the battery rod assembly 200, the elastic element 1103 is in a compressed state, thus a reliable electrical connection of the first elastic electrode 1003 to the atomizer core 120 is formed. Even if the electronic cigarette wobbles in the process of the longtime use or transportation, the electrical connection can be protected from being interrupted by malfunction, thus avoiding the atomizer 100 being unable to work normally due to abnormal electrical connection.

Figure 12:
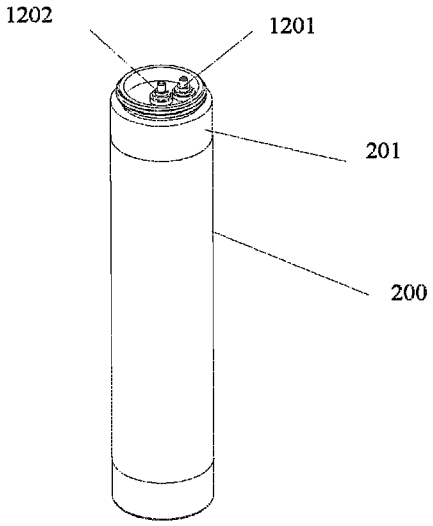
FIG. 12 is a schematic view showing the whole structure of the battery rod assembly provided by the embodiment of the present invention.

It should be noted that the specific structure of the battery rod assembly 200 shown in FIGS. 9, 10 and 11 respectively is illustrated only as an example, which is not a limitation. The specific structure of the battery rod assembly 200 is also as shown in FIG. 12.

Two mounting holes are provided on the connector 201. A first elastic electrode 1201 and a second elastic electrode 1202 are respectively arranged on the two mounting holes, and the first elastic electrode 1201 and the second elastic electrode 1202 are arranged in parallel.

The first elastic electrode 1201 abuts against the first electrode 1262, and the second elastic electrode 1202 abuts against the second electrode 1264.

The advantage of such an arrangement is in that: after the atomizer 100 is connected to the battery rod assembly 200, that is, the first elastic electrode 1201 abuts against the first electrode 1262 and the second elastic electrode 1202 abuts against the second electrode 1264, each of the first elastic electrode 1201 and the second elastic electrode 1202 is in a compressed state, thus reliable electrical connections between the first elastic electrode 1201 and the first electrode 1262 and between the second elastic electrode 1202 and the second electrode 1264 are formed. Even if the electronic cigarette waggles in the process of the longtime use or transportation, the electrical connections can be ensured, thus avoiding the atomizer 100 being unable to work normally due to abnormal electrical connections.

A third embodiment is described. The specific structure of the control unit is described in detail by the present embodiment.

In the present embodiment, the specific structure of the control unit can be implemented in following kinds. It should be noted that the structure of the control unit shown in present embodiment is illustrated below as an example, not a limitation.

Figure 13:
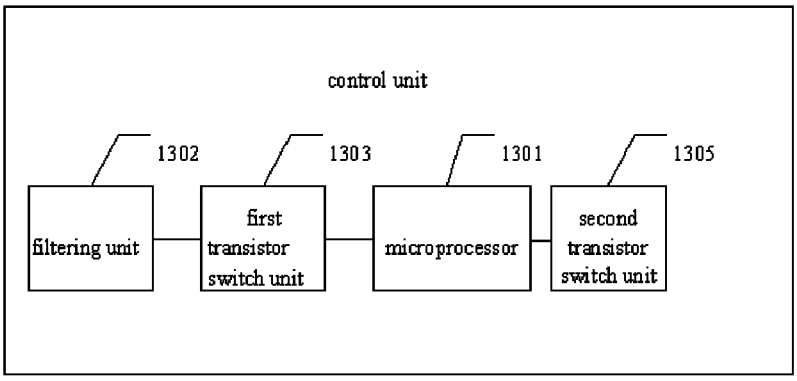
FIG. 13 is a schematic view showing a circuit connection structure of a control unit provided by the embodiment of the present invention.

A first kind is described, as shown in FIG. 13. The control unit includes:

a microprocessor 1301, a filtering unit 1302 electrically connected to a conductive cartridge for filtering an input signal, wherein the specific structures and the arrangement of the suction nozzle and the conductive cartridge can be made reference to the above embodiments, which will not be described in the present embodiment, a first transistor switch unit 1303 electrically connected to the filtering unit 1302 for transmitting an output signal of the filtering unit 1302 to the microprocessor 1301, a second transistor switch unit 1305 electrically connected to the microprocessor 1301 and the atomizer, wherein the specific structure of the atomizer can be made reference to the above embodiments, which will not be repeated in the present embodiment.

The microprocessor 1301 is configured to conduct the first transistor switch unit 1303 and the second transistor switch unit 1305 successively if the suction nozzle is conducted with the conductive cartridge, so as to allow the atomizer to atomize cigarette liquid.

The specific structure of the control unit will be further described in detail below in conjunction with FIG. 14. As an example, J4 is connected to the conductive cartridge, and J3 is connected to the suction nozzle in FIG. 14. Apparently, in order to facilitate operating and smoking, one or more electric conductors electrically connected to J1, J5, J7 respectively can be provided at an outer surface of the electronic cigarette.

The filtering unit 1302 includes a seventh resistance R7, an eighth resistance R8, a first capacitance C1 and a second capacitance C2.

Specifically, an end of the seventh resistance R7 is connected to the ground, and the other end of the seventh resistance R7 is electrically connected to the suction nozzle.

An end of the first capacitance C1 is connected to the suction nozzle, and the other end of the first capacitance C1 is connected to the ground.

An end of the eighth resistance R8 is connected to the suction nozzle, and the other end of the eighth resistance R8 is connected to the first transistor switch unit 1303. An end of the second capacitance C2 is connected to the end of the eighth resistance R8 away from the suction nozzle, and the other end of the second capacitance C2 is connected to the ground.

Further, the first transistor switch unit 1303 includes a first triode Q1 and a first resistance R1.

Figure 14:
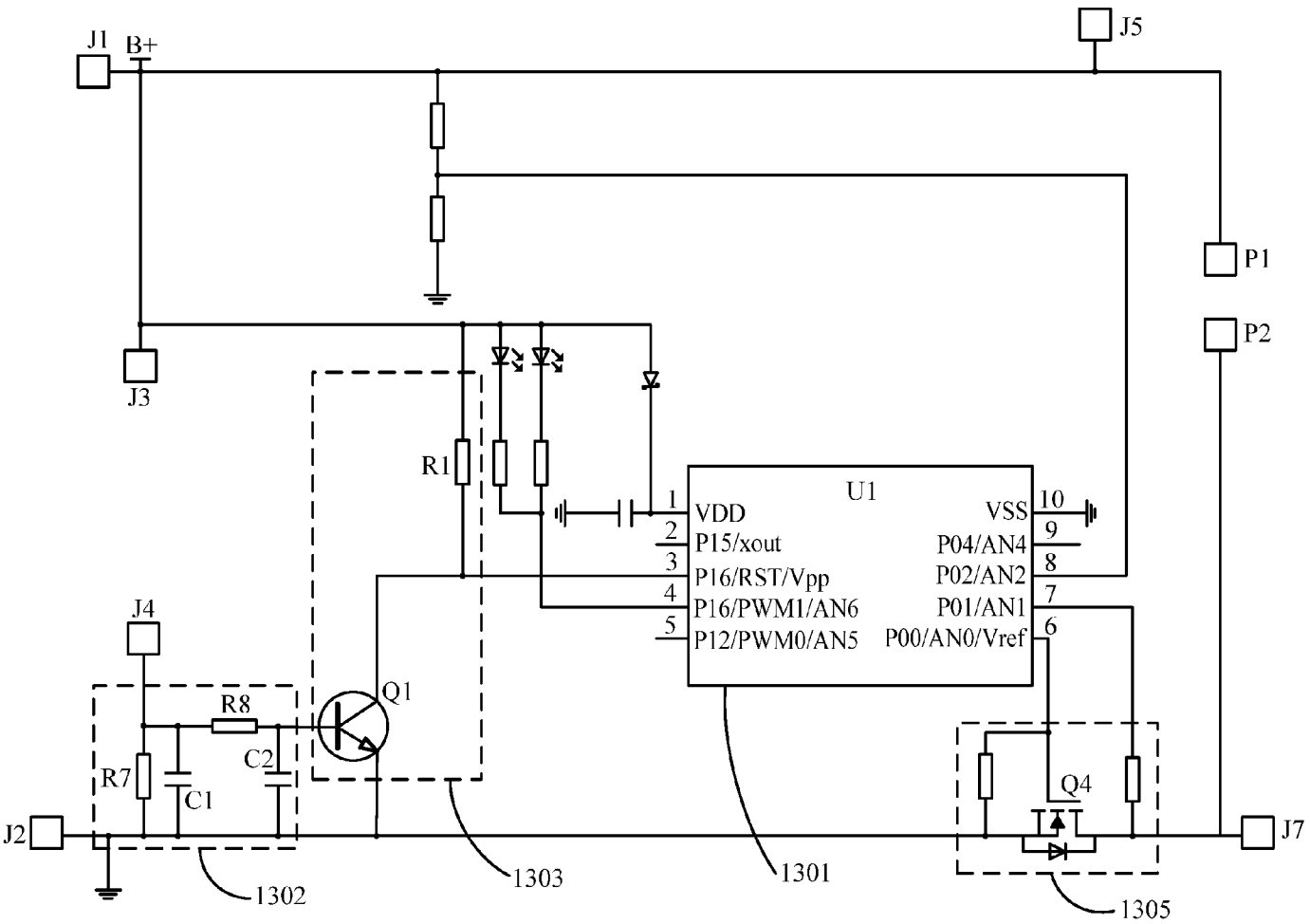
FIG. 14 is a schematic view showing another circuit connection structure of the control unit provided by the embodiment of the present invention.

Specifically, the base of the first triode Q1 is connected to the filtering unit 1302, as shown in FIG. 14, the other end of the eighth resistance R8 is connected to the base of the first triode Q1, so as to connect the filtering unit 1302 and the first transistor switch unit 1303.

The emitting electrode of the first triode Q1 is connected to the ground, and the collector of the first triode Q1 is connected to the first resistance R1 and the microprocessor 1301. The other end of the first electrode R1 is electrically connected to a positive pole of the battery.

Specifically, an electric heating wire is connected between P1 and P2 so as to electrically connect the electric heating wire and the microprocessor 1301.

Preferably, the microprocessor 1301 is implemented as a chip MC32P7010A0I. Apparently, other chips may be adopted, which will not be limited specifically in the present embodiment.

The second transistor switch unit 1305 is electrically connected to the electric heating wire and the microprocessor 1301 respectively.

Specifically, the second transistor switch unit 1305 includes a fourth triode Q4.

The specific workflow of the control unit shown in FIG. 14 will be described in detail below If no one touches the suction nozzle and the conductive cartridge, or touches the suction nozzle and the conductive cartridge simultaneously, the collector of the first triode Q1 of the first transistor switch unit 1303 outputs low level, that is, signal SIG=logic 0, that is, the collector of the first triode Q1 is electrically connected to a "3rd" pin of the microprocessor 1301. When the microprocessor 1301 determines the signal SIG received from the "3rd" pin, =logic 0, the electric heating wire will not be powered.

If the user touches the suction nozzle and the conductive cartridge simultaneously, the signal is first filtered by the filtering unit 1302, and then flows through the first triode Q1 to allow the first triode Q1 to be conducted, such that the SIG signal becomes high level, that is, SIG=logic 1.

When the microprocessor 1301 determines the signal SIG received from the "3rd" pin, =logic 1, the microprocessor 1301 controls the battery to supply power to the electric heating wire.

When the microprocessor 1301 determines the signal SIG received from the "3rd" pin, =logic 1, the microprocessor 1301 controls the fourth triode Q4 to be conducted, such that two ends of the electric heating wire are electrically conducted, which allows the electric heating wire to atomize cigarette liquid into smoke.

Figure 15:
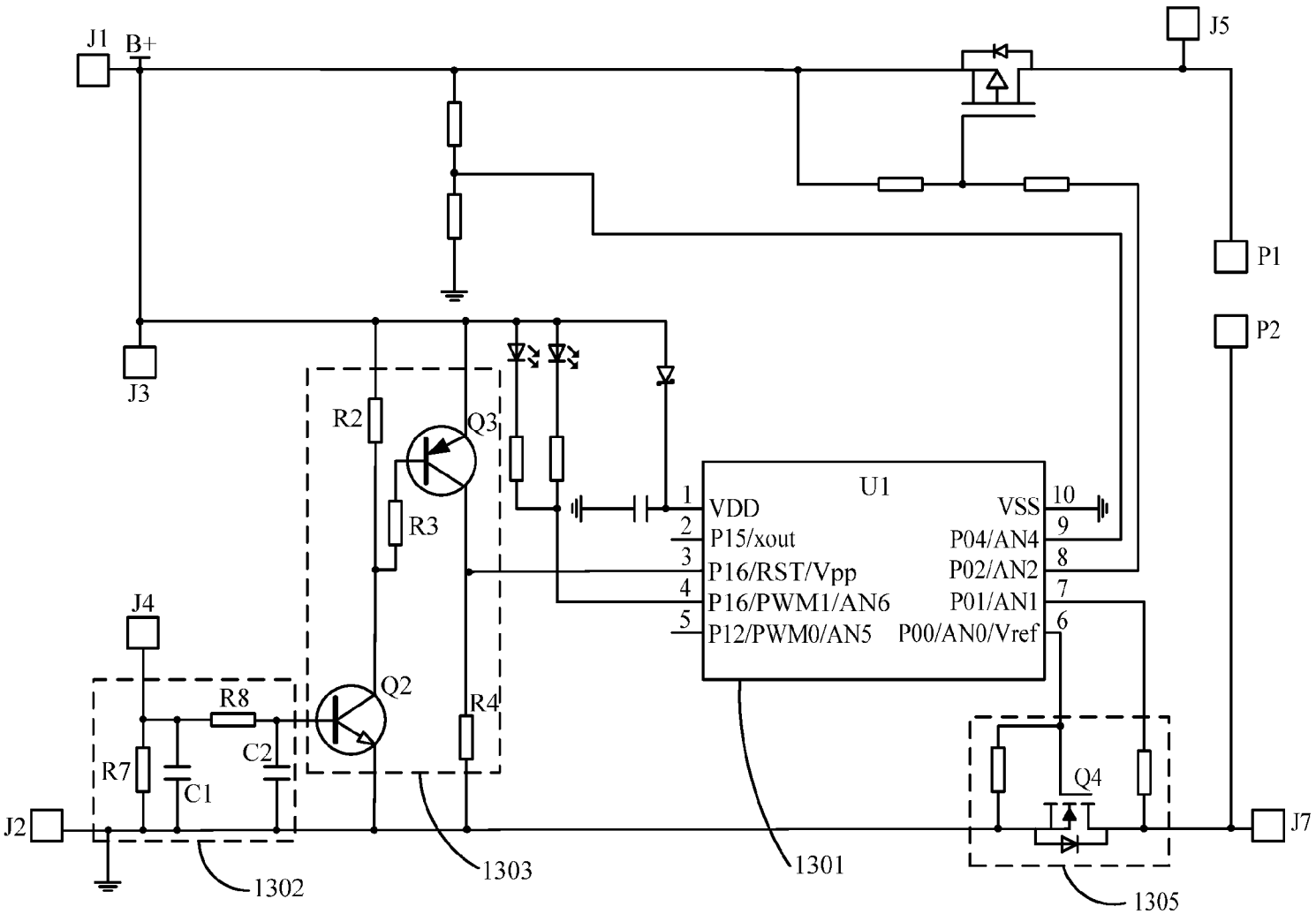
FIG. 15 is a schematic view showing another circuit connection structure of the control unit provided by the embodiment of the present invention.

A second kind can be made reference to FIG. 15. As an example, as shown in FIG. 15, J4 is connected to the conductive cartridge, and J3 is connected to the suction nozzle.

Apparently, in order to facilitate operating and smoking, one or more electric conductors electrically connected to J1, J5, J7 respectively can be provided at an outer surface of the electronic cigarette.

The specific structure of the filtering unit 1302 can be made reference to the first kind of arrangement of the control unit shown in FIG. 15, which will not be described here.

As shown in FIG. 15, the first transistor switch unit 1303 of such a control unit includes a second triode Q2, a third triode Q3, a second resistance R2, a third resistance R3 and a fourth resistance R4.

The base of the second triode Q2 is connected to the filtering unit 1302.

Specifically, the other end of the eighth resistance R8 is connected to the base of the second triode Q2, so as to connect the filtering unit 1302 and the first transistor switch unit 1303.

The emitting electrode of the second triode Q2 is connected to the ground, and the collector of the second triode Q2 is connected to the second resistance R2 and the third resistance R3.

The other end of the second resistance R2 is electrically connected to the positive pole of the battery, and the other end of the third resistance R3 is connected to a base of the third triode Q3.

The emitting electrode of the third triode Q3 is electrically connected to the positive pole of the battery, the collector of the third triode Q3 is electrically connected to the fourth resistance R4 and the microprocessor 1301, and the other end of the fourth resistance R4 is connected to the ground.

Specifically, the electric heating wire is connected between P1 and P2, so as to electrically connect the electric heating wire and the microprocessor 1301.

The specific implemented structure of the microprocessor 1301 is shown in FIG. 15, which will not be described.

A second transistor switch unit 1305 is electrically connected to the microprocessor 1301 and the atomizer.

The specific structure of the atomizer is shown in the above embodiments, which will not be described in the present embodiment.

The microprocessor 1301 is configured to conduct the first transistor switch unit 1303 and the second transistor switch unit 1305 successively if the suction nozzle is conducted with the conductive cartridge, so as to allow the atomizer to atomize the cigarette liquid.

The specific workflow of the control circuit of the electronic cigarette shown in FIG. 15 will be described in detail below.

If no one touches the suction nozzle and the conductive cartridge or touches the suction nozzle and the conductive cartridge simultaneously, the collector of the third triode Q3 of the first transistor switch unit 1303 outputs low level, that is, signal SIG=logic 0, that is, the collector of the third triode Q3 is electrically connected to the "3rd" pin of the microprocessor 1301, when the microprocessor 1301 determines the signal SIG received from the "3" rd pin, =logic 0, the electric heating wire will not be powered.

If the user touches the suction nozzle and the conductive cartridge simultaneously, the signal is first filtered by the filtering unit 1302, and then flows through the second triode Q2 to allow the second triode Q2 to be conducted, such that the SIG signal becomes high level, that is, SIG=logic 1.

When the microprocessor 1301 determines the signal SIG received from the "3rd" pin, =logic 1, the microprocessor 1301 controls the battery to supply power to the electric heating wire.

Specifically, when the microprocessor 1301 determines the signal SIG received from the "3rd" pin, =logic 1, the microprocessor 1301 controls the fourth triode Q4 to be conducted, such that the two ends of the electric heating wire are electrically conducted, which allows the electric heating wire to atomize the cigarette liquid into smoke.

Figure 16:
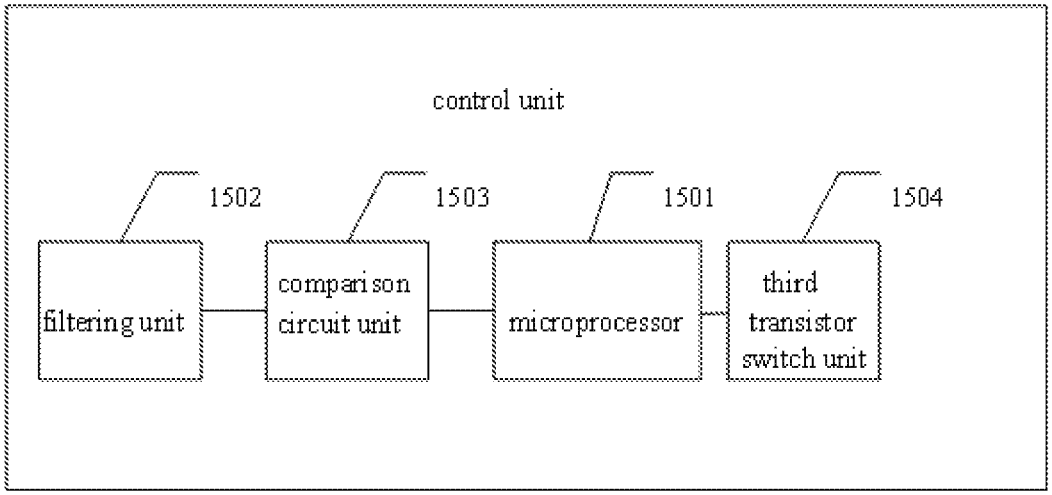
FIG. 16 is a schematic view showing another circuit connection structure of the control unit provided by the embodiment of the present invention.

A third kind is shown in FIG. 16. The control unit includes: a microprocessor 1501, a filtering unit 1502 electrically connected to the conductive cartridge for filtering an input signal, a comparison circuit unit 1503 electrically connected to the filtering unit 1502 for comparing an output signal from the filtering unit 1502 and delivering a comparison result to the microprocessor 1501, a third transistor switch unit 1504 electrically connected to the microprocessor 1501 and the atomizer, wherein the microprocessor 1501 is configured to control the third transistor switch unit 1504 to be turned on or off based on an input signal from the comparison circuit unit 1503, so as to control the atomizer assembly to atomize the cigarette liquid or not.

Figure 17:
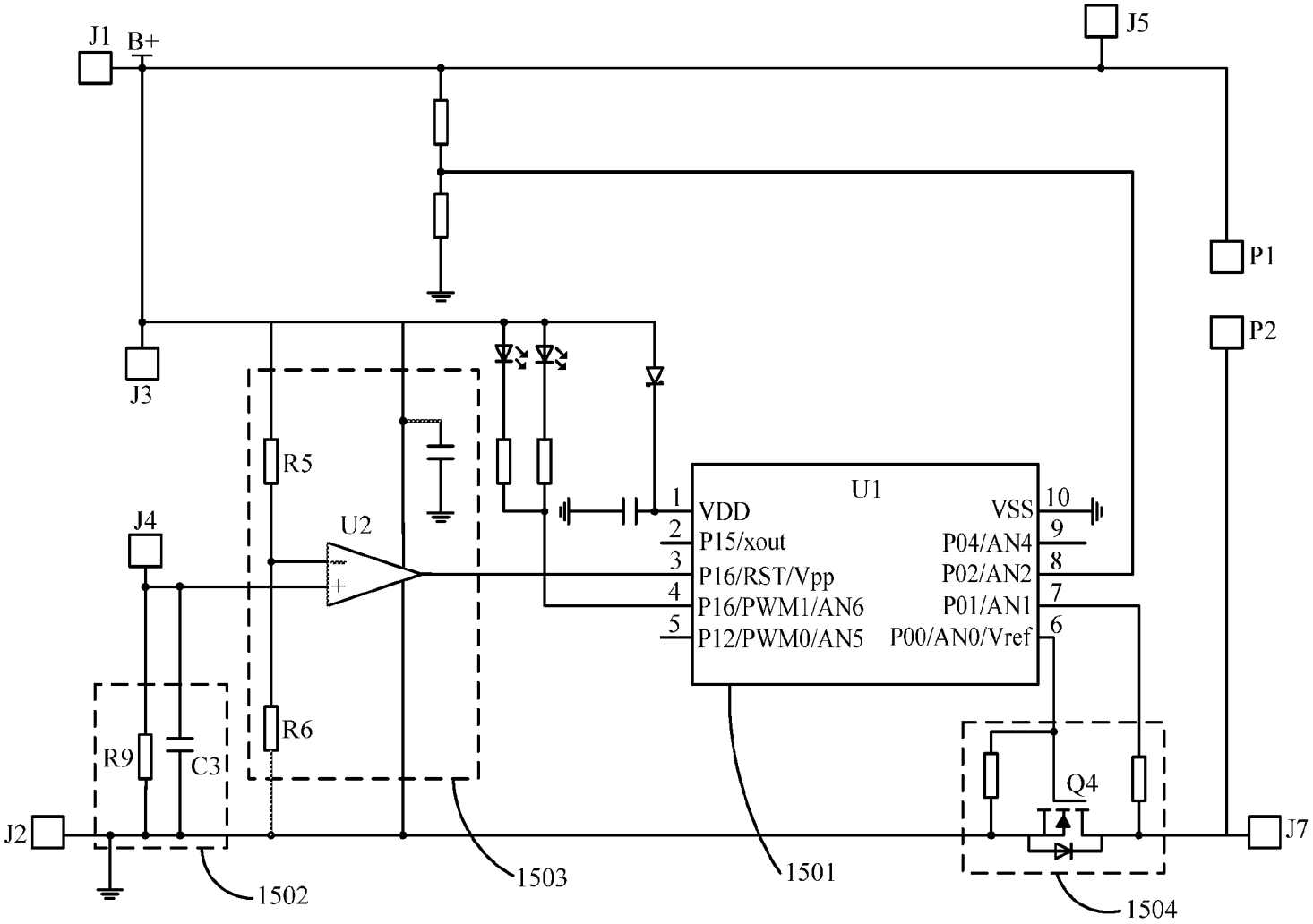
FIG. 17 is a schematic view showing another circuit connection structure of the control unit provided by the embodiment of the present invention.

As shown in FIG. 17, the circuit configuration of the control unit shown in FIG. 16 will be described in detail below.

As an example, as shown in FIG. 17, J4 is connected to the conductive cartridge, and J3 is connected to the suction nozzle. Apparently, in order to facilitate operating and smoking, one or more electric conductors electrically connected to J1, J5, J7 respectively can be provided at an outer surface of the electronic cigarette.

The filtering unit 1502 includes a ninth resistance R9 and a third capacitance C3.

An end of the ninth resistance R9 is connected to the ground, and the other end of the ninth resistance R9 is electrically connected to the suction nozzle.

An end of the third capacitance C3 is connected to the suction nozzle and the comparison circuit unit 1503, and the other end of the third capacitance C3 is connected to the ground.

Further, the comparison circuit unit 1503 includes a comparator U2, a fifth resistance R5 and a sixth resistance R6 connected to the fifth resistance R5 in series.

Specifically, an end of the third capacitance C3 of the filtering unit 1502 is connected to the suction nozzle and a non-inverting input of the comparator U2, so as to connect the filtering unit 1502 and the comparison circuit unit 1503.

An end of the fifth resistance R5 away from the sixth resistance R6 is electrically connected to the positive pole of the battery.

An end of the sixth resistance R6 away from the fifth resistance R5 is connected to the ground, the non-inverting input of the comparator U2 is electrically connected to the suction nozzle, and an inverting input of the comparator U2 is connected to an end of the fifth resistance R5 adjacent to the sixth resistance R6.

Preferably, with cooperation of the filtering unit 1502 with the comparison circuit unit 1503, a substantial fluctuation of the signal transmitted from the conductive cartridge is avoided due to an instable atomization of cigarette liquid by the atomizer caused by different users and locations.

Specifically, the electric heating wire is connected between P1 and P2, so as to connect the electric heating wire and the microprocessor 1501.

The specific implemented structure of the microprocessor 1501 is shown in FIG. 17, which will not be described.

A third transistor switch unit 1504 is electrically connected to the electric heating wire and the microprocessor 1501 respectively.

Specifically, the third transistor switch unit 1504 includes a fourth triode Q4.

The specific workflow of the control circuit of the electronic cigarette shown in FIG. 17 will be described in detail below.

If no one touches the suction nozzle and the conductive cartridge or touches the suction nozzle and the conductive cartridge simultaneously, the output of the comparator U2 outputs low level, that is, signal SIG=logic 0, that is, the output of the comparator U2 is electrically connected to a "3rd" pin of the microprocessor 1501, and when the microprocessor 1501 determines the signal SIG received from the "3rd" pin, =logic 0, the electric heating wire will not be powered.

If the user touches the suction nozzle and the conductive cartridge simultaneously, preferably, wherein the suction nozzle is arranged at the suction nozzle, and the conductive cartridge is arranged at a lower-middle position of the outer surface of the electronic cigarette, the user can touch the suction nozzle and the conductive cartridge simultaneously when smoking normally.

The signal is first filtered by the filtering unit 1502, and then the filtered continuity signal is received by the non-inverting input of the comparator U2 for being compared with a reference voltage signal of the inverting input, and an output end of the comparator U2 outputs a signal indicating the comparative result as a triggering signal to the microprocessor U1.

When the microprocessor U1 determines the signal SIG received from the "3rd" pin, =logic 1, the microprocessor U1 controls the battery to supply power to the electric heating wire.

Specifically, when the microprocessor 1501 determines the signal SIG; received from the "3rd" pin, =logic 1, the microprocessor 1501 controls the fourth triode Q4 to be conducted, such that the two ends of the electric heating wire are electrically conducted, which allows the electric heating wire to atomize the cigarette liquid into smoke.

A fourth embodiment is described. A method for controlling atomization of an electronic cigarette is provided by the present embodiment.

Figure 18:
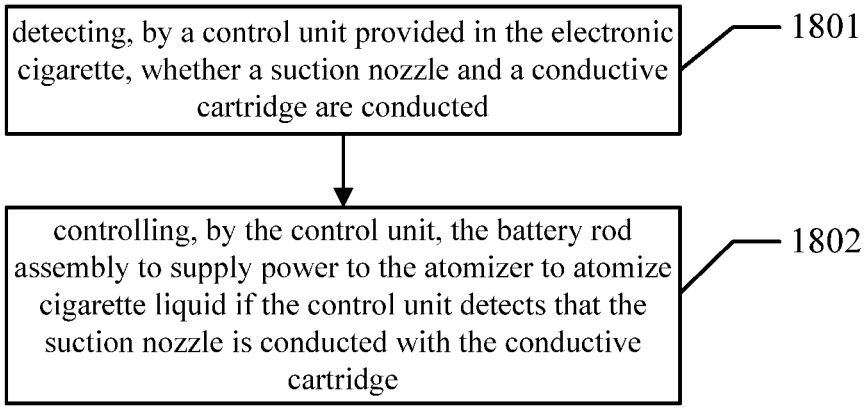
FIG. 18 is a flow diagram showing steps of a method for controlling the atomization of an electronic cigarette provided by the embodiment of the present invention.

As shown in FIG. 18, the method includes:

1801, detecting, by a control unit provided in the electronic cigarette, whether a suction nozzle and a conductive cartridge are conducted, wherein a battery rod assembly configured to supply power to an atomizer is further provided in the electronic cigarette, and the conductive cartridge is sleeved on an outer periphery surface of the battery rod assembly, and each of the suction nozzle and the conductive cartridge is made of a conductive material, and each of the suction nozzle and the conductive cartridge is electrically connected to the control unit, and the specific structures and arrangements of the above means are shown in the above embodiments, which will not be described in the present embodiment,

1802, controlling, by the control unit, the battery rod assembly to supply power to the atomizer to atomize cigarette liquid if the control unit detects that the suction nozzle is conducted with the conductive cartridge, the specific configuration of the electrical connection of the control unit is shown in the above embodiments, which will not be described in the present embodiment.

The advantage of the method for controlling atomization of the electronic cigarette provided by the present embodiment is in that the suction nozzle will not conduct with the conductive cartridge without a corresponding operation of the user (touching the suction nozzle and the conductive cartridge at the outer surface of the electronic cigarette simultaneously), thus in the process of the electronic cigarette packaging and transmutation, a waste of cigarette liquid and an unwanted shortage of service life of the electronic cigarette resulting from the automatic operation of the electronic cigarette without any operations of the user are effectively avoided, thus the security is improved and the possibility that the electric heating wire is triggered unintentionally to atomize cigarette liquid is effectively reduced. If the user wants to smoke, only the suction nozzle and the conductive cartridge need to be touched simultaneously and no sucking or pressing is required, which reduces operation steps and difficulty, and improves the smoking experience. And since there is no need to provide an air flow sensing switch, a cost of the electronic cigarette is effectively reduced, and problems, such as, an unstable sensation of air flow sensor to "smoking" signal due to a small intensity of smoking and a short circuit caused by passing of the cigarette liquid into the battery assembly via the air passage, are avoided. More preferably, the user may naturally touch the suction nozzle and the conductive cartridge simultaneously when smoking, which simplifies steps of smoking and avoids the electric heating wire being unable to work due to a useless touch.

It can be understood clearly by the skilled in the art that for the convenience and concise of the description, the specific working process of the system, device and unit described above can be made reference to the corresponding process in the previous embodiments, which will not be described here.

The above embodiments are only used for illustrating the technical solution of the present application and not for limitation. Although the present application has been illustrated with reference to the previous embodiments, it should be understood by those skilled in the art that modifications can also be made to the technical solution recorded by the previous embodiments, or equivalents can be made to some of the technical features; and such modifications and equivalents do not make essence of the corresponding technical solutions depart from the spirit and scope of the technical solutions in various embodiments of the present application.

The invention claimed is:

1. An electronic cigarette, comprising an atomizer and a battery rod assembly detachably connected to the atomizer, in which the battery rod assembly is provided therein with a battery for supplying power to the atomizer so as to atomize cigarette liquid, wherein the electronic cigarette further comprises a control unit configured to be electrically connected to the atomizer and the battery rod assembly, and the atomizer comprises a liquid cup assembly, a suction nozzle and an atomizer core, and the liquid cup assembly comprises a liquid storage cartridge and an air tube inserted in the liquid storage cartridge, and the suction nozzle made of a conductive material is provided at an end of the liquid cup assembly facing away from the battery rod assembly, and the atomizer core configured to be detachably connected to the liquid cup assembly for atomizing cigarette liquid is provided at the other end of the liquid cup assembly, the atomizer core is provided with a smoke passage and an elastic conductive arm extending into the smoke passage, the air tube made of a conductive material is inserted in the smoke passage and elastically abuts against the elastic conductive arm, the elastic conductive arm is electrically connected to the control unit, the elastic conductive arm is electrically connected to the suction nozzle through the air tube, and a conductive cartridge configured to be electrically connected to the control unit is provided on an outer periphery surface of the battery rod assembly, and a user touches the suction nozzle and the conductive cartridge via skin when smoking, which allows the suction nozzle is conducted with the conductive cartridge, and the control unit controls the battery to supply power to the atomizer to atomize cigarette liquid when it is detected by the control unit that the suction nozzle is conducted with the conductive cartridge.

2. The electronic cigarette according to claim 1, wherein the control unit is provided in the battery rod assembly, and a conductive ring sleeved on the smoke passage is provided at an end of the atomizer core, and an inner periphery surface of the conductive ring is formed with one or more elastic conductive arms extending slantingly in a direction away from the suction nozzle, and an atomizer electrode assembly configured to be electrically connected to the battery rod assembly and the control unit is provided at the other end of the atomizer core, the air tube is inserted in the smoke passage, the elastic conductive arm elastically abuts against a side wall of the air tube, and one of the elastic conductive arms is electrically connected to the atomizer electrode assembly through a wire.

3. The electronic cigarette according to claim 2, wherein a side wall of the atomizer core is provided with an air inlet which is configured to be in communication with an outer surface of the atomizer and the smoke passage, and the atomizer electrode assembly blocks an end of the smoke passage such that the smoke passage is isolated from the battery rod assembly.

4. The electronic cigarette according to claim 2, wherein the atomizer core comprises a hollow atomizing seat, and the atomizing seat is formed therein with a smoke passage, and a liquid storage cavity is provided between the smoke passage and an inner periphery wall of the liquid storage cartridge, a side wall of the atomizing seat is provided with a liquid inlet passage in communication with the liquid storage cavity, the atomizer electrode assembly is interposed at an end of the atomizing seat, the smoke passage is provided therein with a liquid absorber configured to absorb cigarette liquid in the liquid storage cavity from the liquid inlet passage and an electric heating wire configured to atomize the cigarette liquid in the liquid absorber, the atomizer electrode assembly comprises a first insulating cartridge inserted in the atomizing seat, a first electrode inserted in the first insulating cartridge, a second insulating cartridge inserted in the first electrode and a second electrode inserted in the second insulating cartridge, the second electrode has a solid column structure and is electrically connected to the elastic conductive arm, and two ends of the electric heating wire are electrically connected to the atomizing seat and the first electrode respectively to be electrically connected to the battery.

5. The electronic cigarette according to claim 3, wherein the atomizer core comprises a hollow atomizing seat, and the atomizing seat is formed therein with a smoke passage, and a liquid storage cavity is provided between the smoke passage and an inner periphery wall of the liquid storage cartridge, a side wall of the atomizing seat is provided with a liquid inlet passage in communication with the liquid storage cavity, the atomizer electrode assembly is interposed at an end of the atomizing seat, the smoke passage is provided therein with a liquid absorber configured to absorb cigarette liquid in the liquid storage cavity from the liquid inlet passage and an electric heating wire configured to atomize the cigarette liquid in the liquid absorber, the atomizer electrode assembly comprises a first insulating cartridge inserted in the atomizing seat, a first electrode inserted in the first insulating cartridge, a second insulating cartridge inserted in the first electrode and a second electrode inserted in the second insulating cartridge, the second electrode has a solid column structure and is electrically connected to the elastic conductive arm, and two ends of the electric heating wire are electrically connected to the atomizing seat and the first electrode respectively to be electrically connected to the battery.

6. The electronic cigarette according to claim 4, further comprising a wire configured to be electrically connected to the elastic conductive arm and the atomizer electrode assembly, wherein an end of the wire is connected to the elastic conductive arm by welding, and the other end of the wire is sandwiched between the second electrode and the second insulating cartridge.

7. The electronic cigarette according to claim 5, further comprising a wire configured to be electrically connected to the elastic conductive arm and the atomizer electrode assembly, wherein an end of the wire is connected to the elastic conductive arm by welding, and the other end of the wire is sandwiched between the second electrode and the second insulating cartridge.

8. The electronic cigarette according to claim 4, wherein the atomizer core further comprises an atomizing cover configured to be sleeved on an end of the atomizing seat facing away from the battery rod assembly, and an insulator and an elastic seal, both of which are located in the atomizing cover and sleeved on the air tube, two ends of the elastic seal abut against an end wall of the atomizing cover and the insulator respectively, and two ends of the insulator abut against the elastic seal and an end of the atomizing seat, and the conductive ring is sandwiched between the insulator and the elastic seal.

9. The electronic cigarette according to claim 5, wherein the atomizer core further comprises an atomizing cover configured to be sleeved on an end of the atomizing seat facing away from the battery rod assembly, and an insulator and an elastic seal, both of which are located in the atomizing cover and sleeved on the air tube, two ends of the elastic seal abut against an end wall of the atomizing cover and the insulator respectively, and two ends of the insulator abut against the elastic seal and an end of the atomizing seat, and the conductive ring is sandwiched between the insulator and the elastic seal.

10. The electronic cigarette according to claim 4, wherein the liquid storage cartridge is made of a light-transmittable non-metallic material, the suction nozzle is made of a metallic material and is fixed at an end of the liquid storage cartridge, and an end of the liquid storage cartridge facing away from the suction nozzle is fixedly provided with a connecting sleeve configured to be detachably connected to the atomizer core.

11. The electronic cigarette according to claim 5, wherein the liquid storage cartridge is made of a light-transmittable non-metallic material, the suction nozzle is made of a metallic material and is fixed at an end of the liquid storage cartridge, and an end of the liquid storage cartridge facing away from the suction nozzle is fixedly provided with a connecting sleeve configured to be detachably connected to the atomizer core.

12. The electronic cigarette according to claim 1, wherein the battery rod assembly comprises the conductive cartridge made of a metallic material, the battery inserted in the conductive cartridge, a connector configured to be inserted at an end of the conductive cartridge for being connected with the atomizer, and an end cover inserted at an end of the conductive cartridge facing away from the connector, the control unit is provided in the battery rod assembly.

13. The electronic cigarette according to claim 12, wherein the connector comprises a connecting sleeve electrically connected to the control unit, and a first elastic electrode and a second elastic electrode, both of which are inserted into the connecting sleeve, the first elastic electrode is located at an axis of the battery rod assembly, and the first elastic electrode and the second elastic electrode elastically abut against and are electrically connected to the atomizer core.

14. The electronic cigarette according to claim 13, wherein the first elastic electrode comprises a fixing cartridge, an electrode column movably inserted in the fixing cartridge and extending out of the fixing cartridge, and an elastic element, two ends of the elastic element elastically abut against the fixing cartridge and the electrode column respectively, and an end, facing away from the elastic element of the electrode column elastically abuts against the atomizer core.

15. The electronic cigarette according to claim 1, wherein the control unit comprises a microprocessor, a filtering unit configured to be electrically connected to the conductive cartridge for filtering an input signal, a first transistor switch unit configured to be electrically connected to the filtering unit for transmitting an output signal from the filtering unit to the microprocessor, a second transistor switch unit electrically connected to the microprocessor and the atomizer, the microprocessor is configured to control the second transistor switch unit to be turned on or off based on an input signal from the first transistor switch unit, so as to control the atomizer to atomize cigarette liquid or not.

16. The electronic cigarette according to claim 1, wherein the control unit comprises a microprocessor, a filtering unit configured to be electrically connected to the conductive cartridge for filtering an input signal, a comparison circuit unit configured to be electrically connected to the filtering unit for comparing an output signal from the filtering unit and delivering a comparison result to the microprocessor, a third transistor switch unit electrically connected to the microprocessor and the atomizer, the microprocessor is configured to control the third transistor switch unit to be turned on or off based on an input signal from the comparison circuit unit, so as to control the atomizer assembly to atomize cigarette liquid or not.

* * * * *